US007802865B2

(12) United States Patent
Takamiya et al.

(10) Patent No.: US 7,802,865 B2
(45) Date of Patent: Sep. 28, 2010

(54) INK JET PRINTING APPARATUS AND INK JET PRINTING METHOD

(75) Inventors: Hideaki Takamiya, Kawasaki (JP); Hitoshi Nishikori, Tokyo (JP); Daisaku Ide, Tokyo (JP); Hiroshi Tajika, Yokohama (JP); Takashi Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 309 days.

(21) Appl. No.: 12/133,553

(22) Filed: Jun. 5, 2008

(65) Prior Publication Data

US 2008/0238965 A1 Oct. 2, 2008

Related U.S. Application Data

(62) Division of application No. 11/470,699, filed on Sep. 7, 2006, now Pat. No. 7,404,612.

(30) Foreign Application Priority Data

Sep. 9, 2005 (JP) ..... 2005-262370

(51) Int. Cl.
*B41J 29/38* (2006.01)

(52) U.S. Cl. ..... 347/11; 347/10; 347/14

(58) Field of Classification Search ..... 347/11
See application file for complete search history.

(56) References Cited

U.S. PATENT DOCUMENTS

| | | | | |
|---|---|---|---|---|
| 5,880,751 | A | 3/1999 | Nishikori et al. | |
| 6,024,430 | A | 2/2000 | Koitabashi et al. | |
| 6,139,125 | A | 10/2000 | Otsuka et al. | 347/11 |
| 6,439,696 | B1 | 8/2002 | Murakami et al. | |
| 6,457,794 | B1 | 10/2002 | Tajika et al. | |
| 6,547,357 | B1 * | 4/2003 | Tsuruoka | 347/14 |
| 6,644,770 | B1 | 11/2003 | Niimura et al. | |
| 6,648,439 | B2 | 11/2003 | Oikawa | 347/11 |
| 6,652,057 | B2 | 11/2003 | Masuda et al. | |
| 6,729,709 | B2 | 5/2004 | Konno et al. | |
| 6,769,755 | B2 * | 8/2004 | Mizutani et al. | 347/14 |
| 6,988,782 | B2 * | 1/2006 | Imanaka et al. | 347/11 |

FOREIGN PATENT DOCUMENTS

| | | |
|---|---|---|
| JP | 2001-180015 | 7/2001 |
| JP | 2002-347251 | 12/2002 |
| JP | 2003-145892 | 5/2003 |
| JP | 2003-211671 | 7/2003 |
| JP | 2004-001435 | 1/2004 |

* cited by examiner

*Primary Examiner*—Matthew Luu
*Assistant Examiner*—Brian J Goldberg
(74) *Attorney, Agent, or Firm*—Fitzpatrick, Cella, Harper & Scinto

(57) ABSTRACT

The present invention provides an ink jet printing apparatus and an ink jet printing method which are capable of stabilizing the amount of ink ejection and of printing a high-definition image by selecting a driving condition with heat conductivity of an electrothermal converter being taken into consideration. The heat conductivity from a heater to ink is classified into heater ranks, and, on the basis of the heater rank, a voltage of a drive pulse to be applied to the heater is changed.

6 Claims, 25 Drawing Sheets

| | | BASE TEMPERATURE | | | | | | | | | | | |
|---|---|---|---|---|---|---|---|---|---|---|---|---|---|
| | | 20°C | | | 30°C | | | 40°C | | | 50°C | | |
| | | P1(μs) | P3(μs) | VH(V) | P1 PULSE | P3 PULSE | VH | P1 PULSE | P3 PULSE | VH | P1 PULSE | P3 PULSE | VH |
| HEATER RANK | RANK Min | 0.30 | 0.30 | 20.0 | 0.20 | 0.40 | 20.0 | 0.10 | 0.50 | 20.0 | 0.00 | 0.60 | 20.0 |
| | • | • | • | • | • | • | • | • | • | • | • | • | • |
| | • | • | • | • | • | • | • | • | • | • | • | • | • |
| | • | • | • | • | • | • | • | • | • | • | • | • | • |
| | • | • | • | • | • | • | • | • | • | • | • | • | • |
| | RANK MEDIUM | 0.20 | 0.50 | 20.0 | 0.10 | 0.60 | 20.0 | 0.00 | 0.70 | 20.0 | 0.00 | 0.60 | 22.0 |
| | • | • | • | • | • | • | • | • | • | • | • | • | • |
| | • | • | • | • | • | • | • | • | • | • | • | • | • |
| | • | • | • | • | • | • | • | • | • | • | • | • | • |
| | • | • | • | • | • | • | • | • | • | • | • | • | • |
| | RANK Max | 0.10 | 0.70 | 20.0 | 0.00 | 0.80 | 20.0 | 0.00 | 0.70 | 22.0 | 0.00 | 0.60 | 24.0 |

FIG.20

INK JET PRINTING APPARATUS AND INK JET PRINTING METHOD

This is application is a division of U.S. patent application Ser. No. 11/470,699, filed Sep. 7, 2006, now U.S. Pat. No. 7,404,612.

BACKGROUND OF THE INVENTION

1. Field of the Invention

The present invention relates to an ink jet printing apparatus configured to perform printing by ejecting ink, and also relates to an ink jet printing method.

2. Description of the Related Art

An ink jet printing method configured to eject ink from an ink jet printing head to a printing medium and thereby to print an image on the printing medium has heretofore been known. This printing method has advantages including high-speed printing, high-density printing, and ease of color-image printing.

A typical ink jet printing head applies a method of ejecting ink from an ink ejection port by utilizing heat generation of an electrothermal converter (a heater). The printing head of this type is configured to apply a voltage to the heater to generate heat, to make the ink inside ink passage foam by use of that heat energy, and to eject the ink out of the ink ejection port by use of that foaming energy.

The amount of ink ejection of an ink jet printing apparatus using the above-described printing head may fluctuate as the viscosity of the liquid ink or its volume upon foaming changes depending on the temperature inside the printing apparatus and on that of the printing head. For example, a low-temperature printing head makes the amount of ink ejection reduced. As a result, density of a printed image may become lower than intended. On the other hand, when a high-temperature printing head makes the amount of ink ejection increased. As a result, density of a printed image may become higher than intended. In addition, when printing an image by use of plural printing heads, density of such a printed image may fluctuate from part to part depending on a difference in the temperature among the printing heads.

Moreover, the amount of ink ejection is also influenced by uneven heat conductivity among the heaters (hereinafter referred to as a "heater rank") attributable to unevenness in the resistance value and the like. In the course of manufacturing the printing heads, resistance values of electrothermal conversion elements constituting the heaters may differ to some extent, and the difference in the resistance value causes a difference in the energy inputted to the heaters required for ejecting a predetermined amount of ink (ejection threshold energy). Accordingly, the size of the ejected ink droplet may differ among ejection ports even when the same drive voltage is applied to the plural heaters to which the ejection ports correspond.

The double-pulse-drive control is a known technique for stabilizing the amount of ink ejection.

In the double-pulse drive control, a predetermined drive voltage pulse is applied to a heater in the form of two pulses. The first pulse is a pre-heat pulse for allowing the heater to generate the heat to the extent not causing ink ejection so as to adjust the ink temperature in the ink passage. The second pulse is a main heat pulse for allowing the heater to generate enough heat to eject the ink. It is possible to stabilize the amount of ink ejection by adjusting the pulse width of the pre-heat pulse, the pulse width of the main heat pulse, and the interval of these pulses (interval time). For example, the pulse width of the pre-heat pulse is adjusted to be longer in the case where the amount of ink ejection is less than intended as the temperature of the printing head is too low. On the other hand, the pulse width of the pre-heat pulse is adjusted to be shorter in the case where the amount of ink ejection is more than intended as the temperature of the printing head is too high.

Alternatively, Japanese Patent Application Laid-open No. 2001-180015 discloses a method of controlling the amount of ink ejection by changing simultaneously the drive voltage and the drive pulse length of the printing head in response to print data.

However, when a continuous printing operation brings about a rise in the temperature of the printing head, which keeps rising even higher, it may be hardly possible to suppress the increase in the amount of ink ejection only by reducing the width of the pre-heat pulse. After the pulse width of the pre-heat pulse is reduced to zero, the printing head is subject to single-pulse-drive control. Under the single-pulse-drive control, it is difficult to reduce the amount of ink ejection thereafter.

Furthermore, no technique of drive control which responds to a temperature rise on the printing head is disclosed in Japanese Patent Application Laid-open No. 2001-180015. No technique of stabilizing the fluctuating amount of ink ejection, which is attributable to the difference in the heater ranks of the printing heads, and the like, is disclosed, either.

SUMMARY OF THE INVENTION

An object of the present invention is to provide an ink jet printing apparatus and an ink jet printing method, which are capable of printing a high-definition image by stabilizing the amount of ink ejection through the selection of the driving condition with the temperature of the printing head being taken into consideration.

Another object of the present invention is to print a high-definition image by stabilizing the amount of ink ejection through the selection of the driving condition with the heat conductivity of the electrothermal converter being taken into consideration.

Still another object of the present invention is to effectuate the multiple-tone printing, together with the stabilization of the amount of ink ejection, by setting a driving condition of an electrothermal converter in detail over a broad range while using both of the double-pulse-drive control method and the single-pulse-drive control method.

In the first aspect of the present invention, there is provided an ink jet printing apparatus configured to print an image by using a printing head capable of ejecting ink by utilizing thermal energy generated upon application of a drive pulse to an electrothermal converter, the printing being performed by applying the ink ejected from the printing head onto a printing medium, the ink jet printing apparatus comprising:

acquiring means for acquiring information on a temperature of the printing head; and drive controlling means for controlling a voltage and a pulse width of the drive pulse on the basis of the information, wherein the drive controlling means executes double-pulse-drive control using a pre-heat pulse and a main heat pulse collectively as the drive pulse until the temperature of the printing head reaches a predetermined temperature, and the drive controlling means executes single-pulse-drive control using a single pulse as the drive pulse after the temperature of the printing head exceeds the predetermined temperature, and in the single-pulse-drive control, when the temperature of the printing head is in a first temperature range, a first voltage is used as the voltage of the drive pulse, and when the temperature of the printing head is in a second temperature range higher than the first temperature range, a second voltage higher than the first voltage is used as the voltage of the drive pulse.

In the second aspect of the present invention, there is provided an ink jet printing method for printing an image by using a printing head capable of ejecting ink by utilizing thermal energy generated upon application of a drive pulse to an electrothermal converter, the printing being performed by applying the ink ejected from the printing head onto a printing medium, the ink jet printing method comprising the steps of:

acquiring information on a temperature of the printing head; and controlling a voltage and a pulse width of the drive pulse on the basis of the information, wherein the controlling step executes double-pulse-drive control using a pre-heat pulse and a main heat pulse collectively as the drive pulse until the temperature of the printing head reaches a predetermined temperature, and the controlling step executes single-pulse-drive control using a single pulse as the drive pulse after the temperature of the printing head exceeds the predetermined temperature, and in the single-pulse-drive control, when the temperature of the printing head is in a first temperature range, a first voltage is used as the voltage of the drive pulse, and when the temperature of the printing head is in a second temperature range higher than the first temperature range, a second voltage higher than the first voltage is used as the voltage of the drive pulse.

According to the present invention, it is possible to obtain a desired amount of ink ejection stably by changing the voltage of the drive pulse for an electrothermal converter. Specifically, when foaming the ink by use of the thermal energy generated by the electrothermal converter and ejecting the ink by use of the foaming energy, the amount of ink ejection depends on the size of that bubble. The size of the bubble is determined by the voltage and the pulse width of the drive pulse for the electrothermal converter, and the amount of ink ejection can be controlled by controlling both of these parameters.

For example, the case of raising the voltage of the drive pulse while reducing the pulse width thereof is compared with the case of reducing the voltage of the drive pulse while increasing the pulse width thereof. In the former case, the amount of ink ejection becomes lower than the latter case, because of the shorter time period for transmission of the heat from the electrothermal converter to the ink. This is attributable to reduction in the thickness of an ink layer (a high temperature layer) to be heated to a high temperature and to contribute to foaming in the former case. Therefore, it is effective to apply a drive pulse having a high voltage and a small pulse width in order to reduce the amount of ink ejection. On the other hand, it is effective to apply a drive pulse having a low voltage and a large pulse width in order to increase the amount of ink ejection.

The inventor of the present invention actually measured the size of bubbles to be formed on an electrothermal converter. It was confirmed that raising the voltage and reducing the pulse width of the drive pulse produced the bubbles apparently smaller. This measurement was carried out so as to keep the energy inputted to the electrothermal converter was constant. The voltage is determined in response to the pulse width so that the size of the pulse width might not cause fluctuation in the energy inputted to the electrothermal converter. In this way, by changing the voltage and the width of the drive pulse simultaneously, it is possible to control the foaming force of the ink jet printing head and also to change the amount of ink ejection when using the same electrothermal converter.

For example, it is possible to obtain a constant amount of ink ejection by gradually raising the voltage of the drive pulse and reducing the pulse width as the temperature of the printing head rising, or by gradually reducing the voltage of the drive pulse and increasing the pulse as the temperature of the printing head dropping.

A controllable range of the amount of ink ejection should be set wide enough to maintain the constant amount of ink ejection in a broader temperature range. To this end, when the printing head has a relatively low temperature, the double-pulse-drive method may be used, and when the printing head has a relatively high temperature, the voltage of the drive pulse and the pulse width may be changed simultaneously, by switching to the single-pulse-drive method. Alternatively, it is also possible to apply the single-pulse-drive method without using the double-pulse-drive method when the controllable range of the amount of ink ejection is sufficient merely by changing the voltage of the drive pulse and the pulse width at the same time.

Moreover, the heat conductivity of the electrothermal converter may be rated as the heater rank corresponding to elapsed time from application of the drive pulse thereto to initiation of ink foaming. An electrothermal converter that has high heat conductivity with the above elapsed time being short, i.e. an electrothermal converter having a small energy threshold necessary for ink ejection, ranks low in the heater rank. In contrast, an electrothermal converter that has low heat conductivity with the above elapsed time being long, i.e. an electrothermal converter having a large energy threshold necessary for ink ejection, ranks high in the heater rank. Accordingly, it is possible to obtain a constant amount of ink ejection at all times by making the voltage of the drive pulse lower and the pulse width larger for a lower-rank heater, and by making the voltage of the drive pulse higher and the pulse width smaller for the a higher-rank heater.

According to the present invention, it is possible to print a high-definition image by stabilizing the amount of ink to be ejected from the printing head irrespective of fluctuations which may occur in its temperature. Moreover, it is possible to widen the controllable range within which the amount of ink ejection can be stabilized.

Further features of the present invention will become apparent from the following description of exemplary embodiments (with reference to the attached drawings).

BRIEF DESCRIPTION OF THE DRAWINGS

FIG. 20 is a chart showing a correspondence table between heater ranks and head temperatures used in the embodiment of the present invention;

DESCRIPTION OF THE EMBODIMENTS

Figure 1:
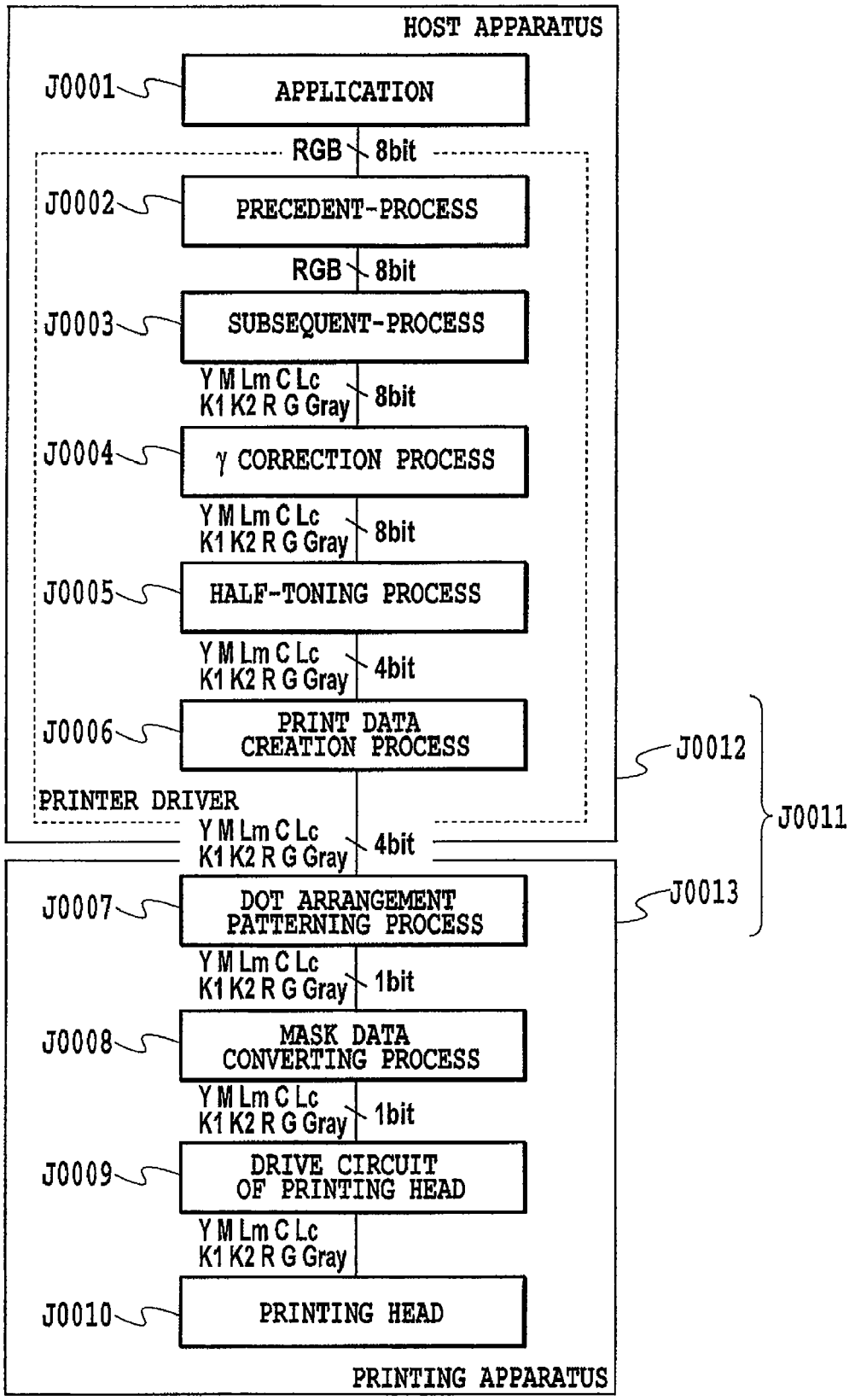
FIG. 1 is a view for explaining a flow of image data processing in a printing system applied to an embodiment of the present invention.

Descriptions will be provided below for embodiments of the present invention by referring to the drawings.

1. Basic Configuration

1.1 Outline of Printing System

FIG. 1 is a diagram for explaining a flow in which image data are processed in a printing system to which an embodiment of the present invention is applied. This printing system J0011 includes a host apparatus J0012 which generates image data indicating an image to be printed, and which sets up a user interface (UI) for generating the data and so on. In addition, the printing system J0011 includes a printing apparatus J0013 which prints an image on a printing medium on the basis of the image data generated by the host apparatus J0012. The printing apparatus J0013 performs a printing operation by use of 10 color inks of cyan (C), light cyan (Lc), magenta (M), light magenta (Lm), yellow (Y), red (R), green (G), black 1 (K1), black 2 (K2) and gray (Gray). To this end, a printing head H1001 for ejecting these 10 color inks is used for the printing apparatus J0013. These 10 color inks are pigmented inks respectively including ten color pigments as the color materials thereof.

Programs operated with an operating system of the host apparatus J0012 include an application and a printer driver. An application J0001 executes a process of generating image data with which the printing apparatus makes a print. Personal computers (PC) are capable of receiving these image data or pre-edited data which is yet to process by use of various media. By means of a CF card, the host apparatus according to this embodiment is capable of populating, for example, JPEG-formatted image data associated with a photo taken with a digital camera. In addition, the host apparatus according to this embodiment is capable of populating, for example, TIFF-formatted image data read with a scanner and image data stored in a CD-ROM. Moreover, the host apparatus according to this embodiment is capable of capturing data from the Web through the Internet. These captured data are displayed on a monitor of the host apparatus. Thus, an edit, a process or the like is applied to these captured data by means of the application J0001. Thereby, image data R, G and B are generated, for example, in accordance with the sRGB specification. A user sets up a type of printing medium to be used for making a print, a printing quality and the like through a UI screen displayed on the monitor of the host apparatus. The user also issues a print instruction through the UI screen. Depending on this print instruction, the image data R, G and B are transferred to the printer driver.

The printer driver includes a precedent process J0002, a subsequent process J0003, a γ correction process J0004, a half-toning process J0005 and a print data creation process J0006 as processes performed by itself. Brief descriptions will be provided below for these processes J0002 to J0006.

(A) Precedent Process

The precedent process J0002 performs mapping of a gamut. In this embodiment, data are converted for the purpose of mapping the gamut reproduced by image data R, G and B in accordance with the sRGB specification onto a gamut to be produced by the printing apparatus. Specifically, a respective one of image data R, G and B deal with 256 gradations of the respective one of colors which are represented by 8 bits. These image data R, G and B are respectively converted to 8-bit data R, G and B in the gamut of the printing apparatus J0013 by use of a three-dimensional LUT.

(B) Subsequent Process

On the basis of the 8-bit data R, G and B obtained by mapping the gamut, the subsequent process J0003 obtains 8-bit color separation data on each of the 10 colors. The 8-bit color separation data correspond to a combination of inks which are used for reproducing a color represented by the 8-bit data R, G and B. In other words, the subsequent process J0003 obtains color separation data on each of Y, M, Lm, C, Lc, K1, K2, R, G, and Gray. In this embodiment, like the precedent process, the subsequent process is carried out by using the three dimensional LUT, simultaneously using an interpolating operation.

(C) γ Correction Process

The γ correction J0004 converts the color separation data on each of the 10 colors which have been obtained by the subsequent process J0003 to a tone value (gradation value) representing the color. Specifically, a one-dimensional LUT corresponding to the gradation characteristic of each of the color inks in the printing apparatus J0013 is used, and thereby a conversion is carried so that the color separation data on the 10 colors can be linearly associated with the gradation characteristics of the printer.

(D) Half-Toning Process

The half-toning process J0005 quantizes the 8-bit color separation data on each of Y, M, Lm, C, Lc, K1, K2, R, G and Gray to which the γ correction process has been applied so as to convert the 8-bit separation data to 4-bit data. In this embodiment, the 8-bit data dealing with the 256 gradations of each of the 10 colors are converted to 4-bit data dealing with 9 gradations by use of the error diffusion method. The 4-bit data are data which serve as indices each for indicating a dot arrangement pattern in a dot arrangement patterning process in the printing apparatus.

(E) Print Data Creation Process

The last process performed by the printer driver is the print data creation process J0006. This process adds information on print control to data on an image to be printed whose contents are the 4-bit index data, and thus creates print data.

Figure 2:
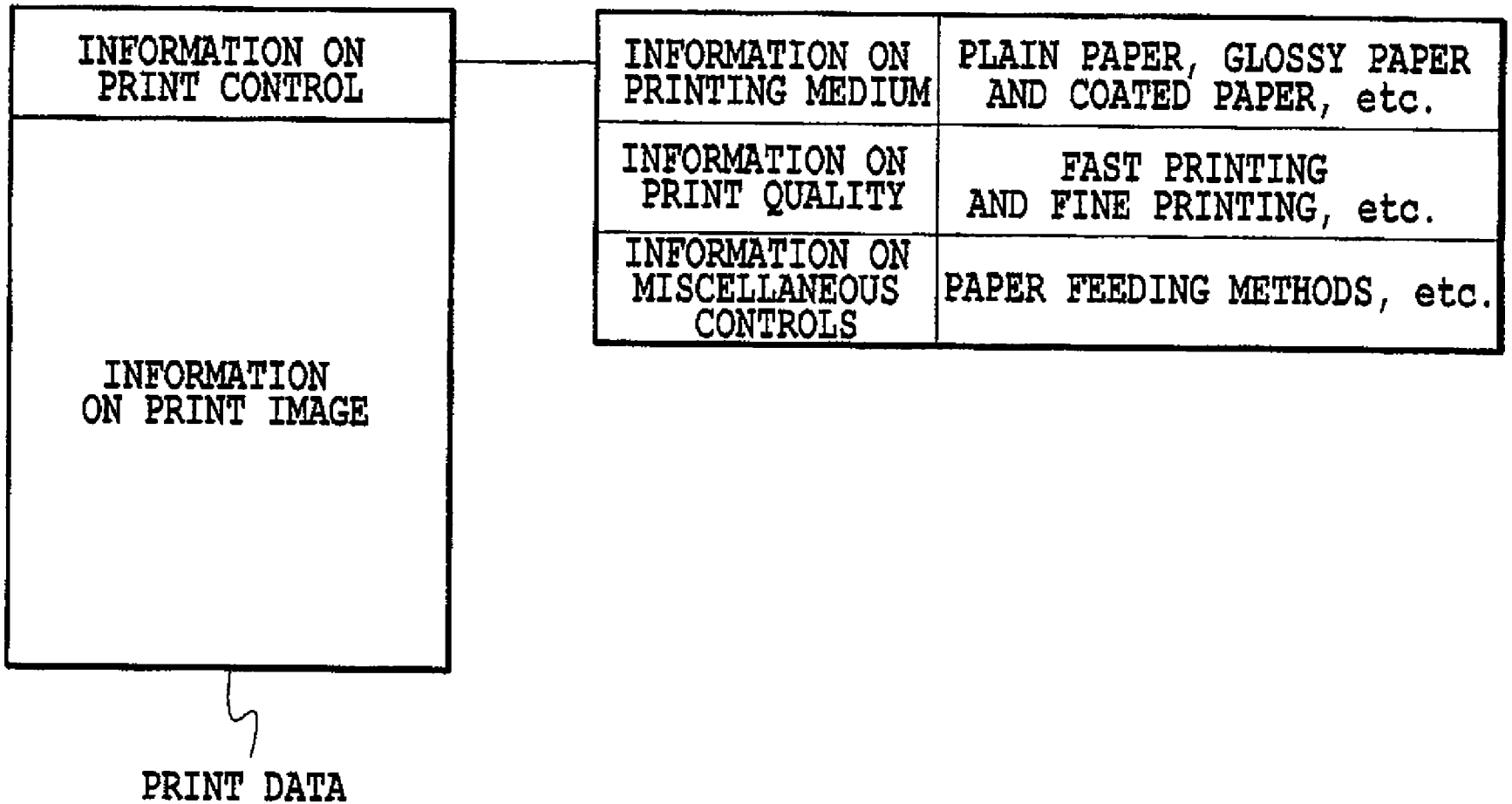
FIG. 2 is an explanatory view showing a configuration example of printing data to be transferred from the printer driver of the host apparatus to the printing apparatus in the printing system shown in FIG. 1.

FIG. 2 is a diagram showing an example of a configuration of the print data. The print data are configured of the information on print control and the data on an image to be printed. The information on print control is in charge of controlling a printing operation. The data on an image to be printed indicates an image to be printed (the data are the foregoing 4-bit index data). The information on print control is configured of "information on printing media," "information on print qualities," and "information on miscellaneous controls" including information on paper feeding methods or the like. Types of printing media on which to make a print are described in the information on printing media. One type of printing medium selected out of a group of plain paper, glossy paper, a post card, a printable disc and the like is specified in the information on printing media. Print qualities to be sought are described in the information on print qualities. One type of print quality selected out of a group of "fine (high-quality print)," "normal," "fast (high-speed print)" and the like is specified in the information on print qualities. Note that these pieces of information on print control are formed on the basis of contents which a user designates through the UI screen in the monitor of the host apparatus J0012. In addition, image data originated in the half-toning process J0005 are described in the data on an image to be printed. The print data thus generated are supplied to the printing apparatus J0013.

The printing apparatus J0013 performs a dot arrangement patterning process J0007 and a mask data converting process J0008 on the print data which have been supplied from the host apparatus J0012. Descriptions will be provided next for the dot arrangement patterning process J0007 and the mask data converting process J0008.

(F) Dot Arrangement Patterning Process

In the above-described half-toning process J0005, the number of gradation levels is reduced from the 256 tone values dealt with by multi-valued tone information (8-bit data) to the 9 tone values dealt with by information (4-bit data). However, data with which the printing apparatus J0013 is actually capable of making a print are binary data (1-bit) data on whether or not an ink dot should be printed. Taken this into consideration, the dot arrangement patterning process J0007 assigns a dot arrangement pattern to each pixel represented by 4-bit data dealing with gradation levels 0 to 8 which are an outputted value from the half-toning process J0005. The dot arrangement pattern corresponds to the tone value (one of the levels 0 to 8) of the pixel. Thereby, whether or not an ink dot should be printed (whether a dot should be on or off) is defined for each of a plurality of areas in each pixel. Thus, 1-bit binary data indicating "1 (one)" or "0 (zero)" are assigned to each of the areas of the pixel. In this respect, "1 (one)" is binary data indicating that a dot should be printed. "0 (zero)" is binary data indicating that a dot should not be printed.

Figure 3:
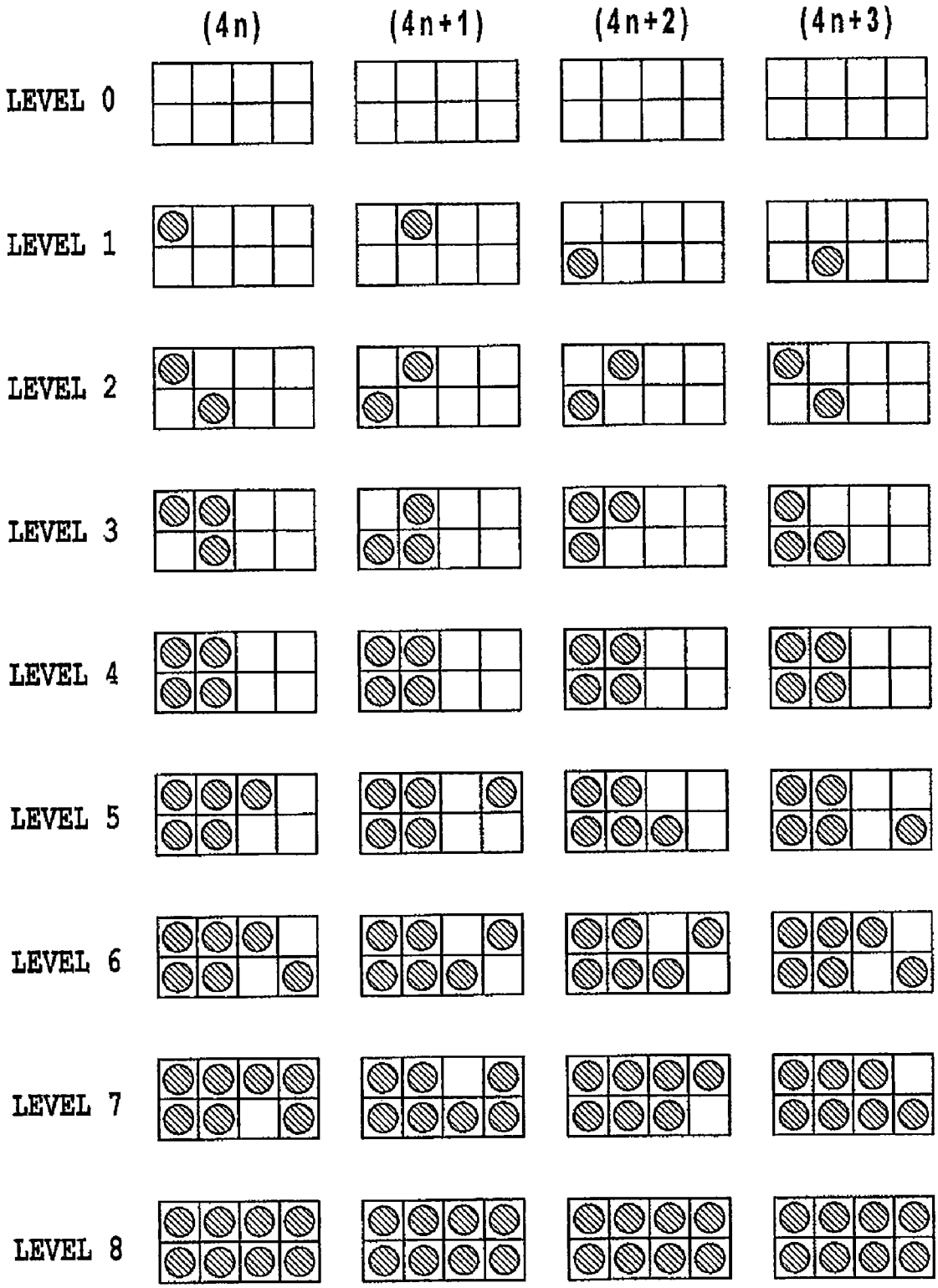
FIG. 3 is a view showing output patterns relative to input levels which are converted in the course of a dot arrangement patterning process by the printing apparatus used in the embodiment.

FIG. 3 shows output patterns corresponding to input levels 0 to 8. These output patterns are obtained through the conversion performed in the dot arrangement patterning process of the embodiment. Level numbers in the left column in the diagram correspond respectively to the levels 0 to 8 which are the outputted values from the half-toning process in the host apparatus. Regions each configured of 2 vertical areas×4 horizontal areas are shown to the right of this column. Each of the regions corresponds to a region occupied by one pixel receiving an output from the half-toning process. In addition, each of the areas in one pixel corresponds to a minimum unit for which it is specified whether the dot thereof should be on or off. Note that, in this description, a "pixel" means a minimum unit which is capable of representing a gradation, and also means a minimum unit to which the image processes (the precedent process, the subsequent process, the γ correction process, the half-toning process and the like) are applied using multi-valued data represented by the plurality of bits.

In this figure, an area in which a circle is drawn denotes an area where a dot is printed. As the level number increases, the number of dots to be printed increases one-by-one. In this embodiment, information on density of an original image is finally reflected in this manner.

From the left to the right, (4n) to (4n+3) denotes horizontal positions of pixels, each of which receives data on an image to be printed. An integer not smaller than 1 (one) is substituted for n in the expression (4n) to (4n+3). The patterns listed under the expression indicate that a plurality of mutually-different patterns are available depending on a position where a pixel is located even though the pixel receives an input at the same level. In other words, the configuration is that, even in a case where a pixel receives an input at one level, the four types of dot arrangement patterns under the expression (4n) to (4n+3) at the same level are assigned to the pixel in an alternating manner.

In FIG. 3, the vertical direction is a direction in which the ejection openings of the printing head are arrayed, and the horizontal direction is a direction in which the printing head moves. The configuration enabling a print to be made using the plurality of different dot arrangement patterns for one level brings about the following two effects. First, the number of times that ejection is performed can be equalized between two nozzles in which one nozzle is in charge of the patterns located in the upper row of the dot arrangement patterns at one level, and the other nozzle is in charge of the patterns located in the lower row of the dot arrangement patterns at the same level. Secondly, various noises unique to the printing apparatus can be reduced.

When the above-described dot arrangement patterning process is completed, the assignment of dot arrangement patterns to the entire printing medium is completed.

(G) Mask Data Converting Process

In the foregoing dot arrangement patterning process J0007, whether or not a dot should be printed is determined for each of the areas on the printing medium. As a result, if binary data indicating the dot arrangement are inputted to a drive circuit J0009 of the printing head H1001, a desired image can be printed. In this case, what is termed as a one-pass print can be made. The one-pass print means that a print to be made for a single scan region on a printing medium is completed by the printing head H1001 moving once. Alternatively, what is termed as a multi-pass print can be made. The multi-pass print means that a print to be made for a single scan region on the printing medium is completed by the printing head moving a plurality of times. Here, descriptions will be provided for a mask data converting process, taking an example of the multi-pass print.

Figure 4:
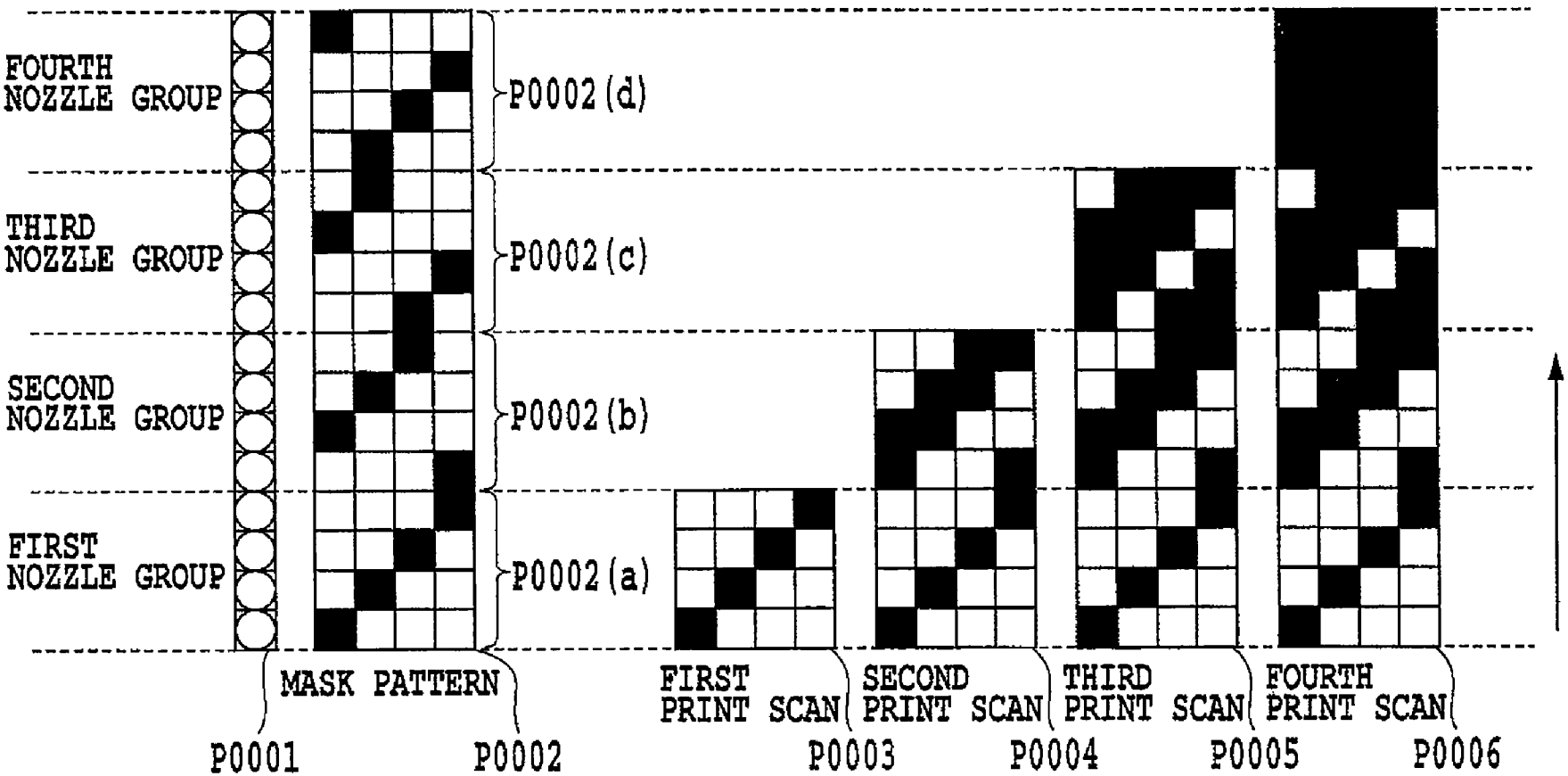
FIG. 4 is a schematic drawing for explaining a multipass printing method which is executed by the printing apparatus used in the embodiment.

FIG. 4 is a schematic diagram showing the printing head and print patterns for the purpose of describing the multi-pass printing method. The print head H1001 applied to this embodiment actually has 768 nozzles. For the sake of convenience, however, descriptions will be provided for the printing head and the print patterns, supposing that the printing head H1001 has 16 nozzles. The nozzles are divided into a first to a fourth nozzle groups. Each of the four nozzle groups includes four nozzles. Mask P0002 are configured of a first to a fourth mask patterns P0002(*a*) to P0002(*d*). The first to the fourth mask patterns P0002(*a*) to P0002(*d*) define the respective areas in which the first to the fourth nozzle groups are capable of making a print. Blackened areas in the mask patterns indicate printable areas, whereas whitened areas in the mask patterns indicate unprinted areas. The first to the fourth mask patterns are complementary to one another. The configuration is that, when these four mask patterns are superposed over one another, a print to be made in a region corresponding to a 4×4 area is completed.

Patterns denoted by reference numerals P0003 to P0006 show how an image is going to be completed by repeating a print scan. Each time a print scan is completed, the printing medium is transferred by a width of the nozzle group (a width of four nozzles in this figure) in a direction indicated by an arrow in the figure. In other words, the configuration is that an image in any same region (a region corresponding to the width of each nozzle region) on the printing medium is completed by repeating the print scan four times. Formation of an image in any same region on the printing medium by use of multiple nozzle groups by repeating the scan the plurality of times in the aforementioned manner makes it possible to bring about an effect of reducing variations characteristic of the nozzles, and an effect of reducing variations in accuracy in transferring the printing medium.

Figure 5:
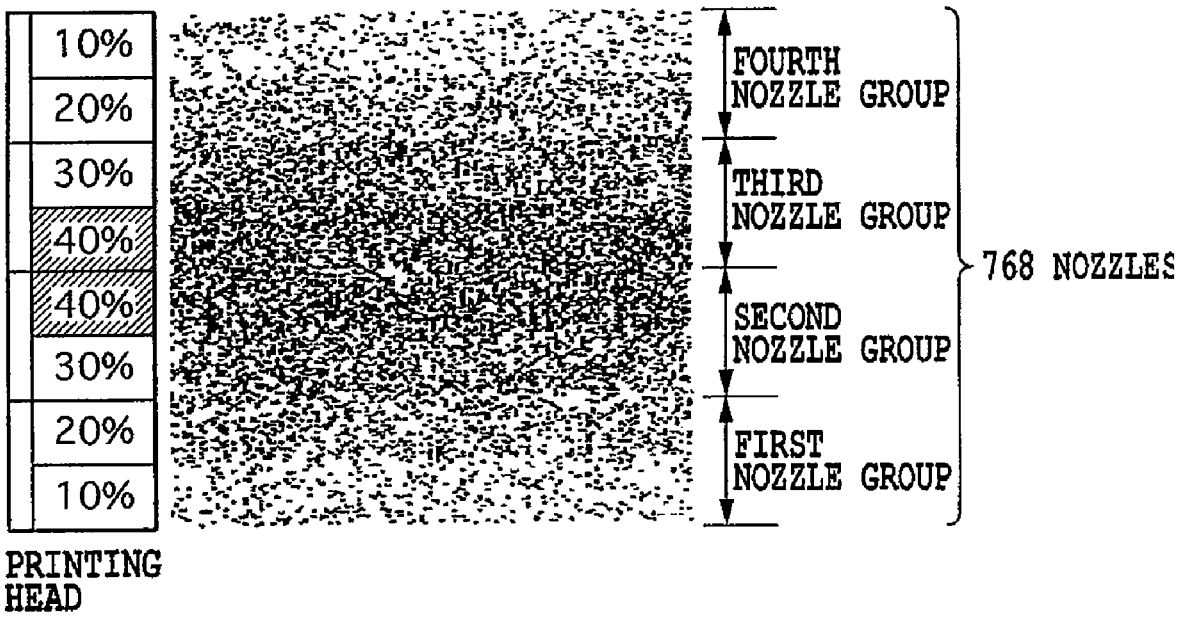
FIG. 5 is an explanatory view showing an example of a mask pattern to be applied to the multipass printing method which is executed by the printing apparatus used in the embodiment.

FIG. 5 shows an example of mask which is capable of being actually applied to this embodiment. The printing head H1001 to which this embodiment is applied has 768 nozzles, and 192 nozzles belong to each of the four nozzle groups. As for the size of the mask, the mask has 768 areas in the vertical direction, and this number is equal to the number of nozzles. The mask has 256 areas in the horizontal direction. The mask has a configuration that the four mask patterns respectively corresponding to the four nozzle groups maintain a complementary relationship among themselves.

In the case of the ink jet printing head applied to this embodiment, which ejects a large number of fine ink droplets by means of a high frequency, it has been known that an air flow occurs in a neighborhood of the printing part during printing operation. In addition, it has been proven that this air flow particularly affects a direction in which ink droplets are ejected from nozzles located in the end portions of the printing head. For this reason, in the case of the mask patterns of this embodiment, a distribution of printable ratios is biased depending on which nozzle group a region belongs to, and on where a region is located in each of the nozzle groups, as seen from FIG. 5. As shown in FIG. 5, by employing the mask patterns having a configuration which makes the printable ratios of the nozzles in the end portions of the printing head smaller than those of nozzles in a central portion thereof, it is possible to make inconspicuous an adverse effect stemming from variations in positions where ink droplets ejected from the nozzles in the end portions of the printing head are landed.

Note that a printable ratio specified by a mask pattern is as follows. A printable ratio of a mask pattern is a percentage denomination of a ratio of the number of printable areas constituting the mask pattern (blackened areas in the mask pattern P0002(*a*) to P0002(*d*) of FIG. 4) to the sum of the number of printable areas and the number of unprintable areas constituting the mask pattern (the whitened areas in the mask patterns P0002(*a*) to P0002(*d*) of FIG. 4). In other words, a printable ratio (%) of a mask pattern is expressed by $$M \div (M+N) \times 100$$

where M denotes the number of printable areas constituting the mask pattern and N denotes the number of unprintable areas constituting the mask pattern.

In this embodiment, data for the mask as shown in FIG. 5 are stored in memory in the main body of the printing apparatus. The mask data converting process J0008 performs the AND process on the mask data with the binary data obtained in the foregoing dot arrangement patterning process. Thereby, binary data to be a print object in each print scan are determined. Subsequently, the binary data are transferred to the driving circuit J0009. Thus, the printing head H1001 is driven, and hence inks are ejected in accordance with the binary data.

FIG. 1 shows that the host apparatus J0012 is configured to perform the precedent process J0002, the subsequent process J0003, the γ correction process J0004, the half-toning process J0005 and the print data creation process J0006. In addition, FIG. 1 shows that the printing apparatus J0013 is designed to perform the dot arrangement patterning process J0007 and the mask data converting process J0008. However, the present invention is not limited to this embodiment. For example, the present invention may be carried out as an embodiment in which parts of the processes J0002 to J0005 are designed to be performed by the printing apparatus J0013 instead of by the host apparatus J0012. Otherwise, the present invention may be carried out as an embodiment in which all of these processes are designed to be performed by the host apparatus J0012. Alternately, the present invention may be carried out as an embodiment in which the processes J0002 to J0008 are designed to be performed by the printing apparatus J0013.

1.2 Configuration of Mechanisms

Descriptions will be provided for a configuration of the mechanisms in the printing apparatus to which this embodiment is applied. The main body of the printing apparatus of this embodiment is divided into a paper feeding section, a paper transferring section, a paper delivery section, a carriage section, a flat-pass printing section and a cleaning section from a viewpoint of functions performed by the mechanisms. These mechanisms are contained in an outer case. The cleaning section cleans the face of nozzle.

Figure 6:
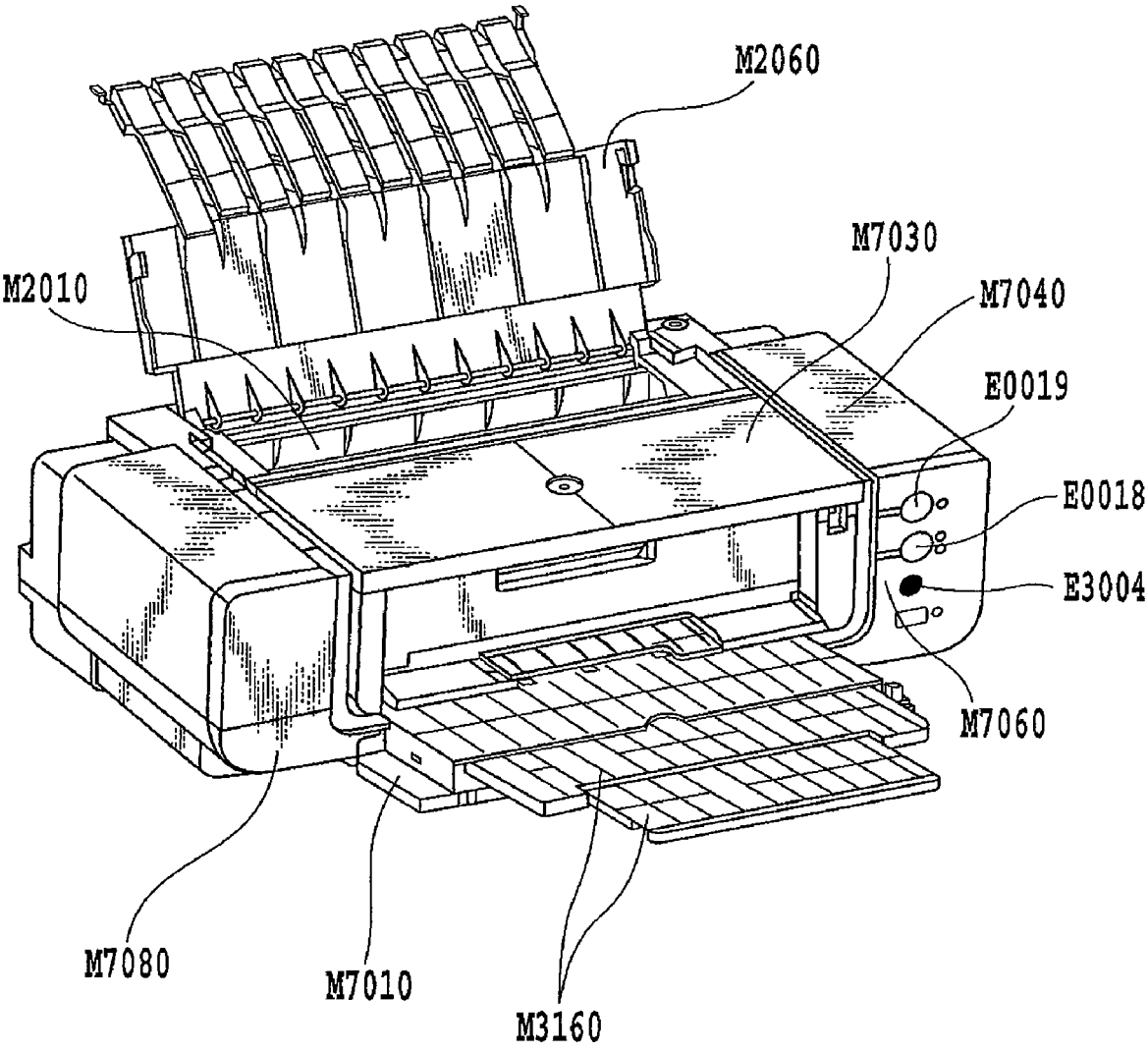
FIG. 6 is a perspective view of the printing apparatus used in the embodiment.
Figure 7:
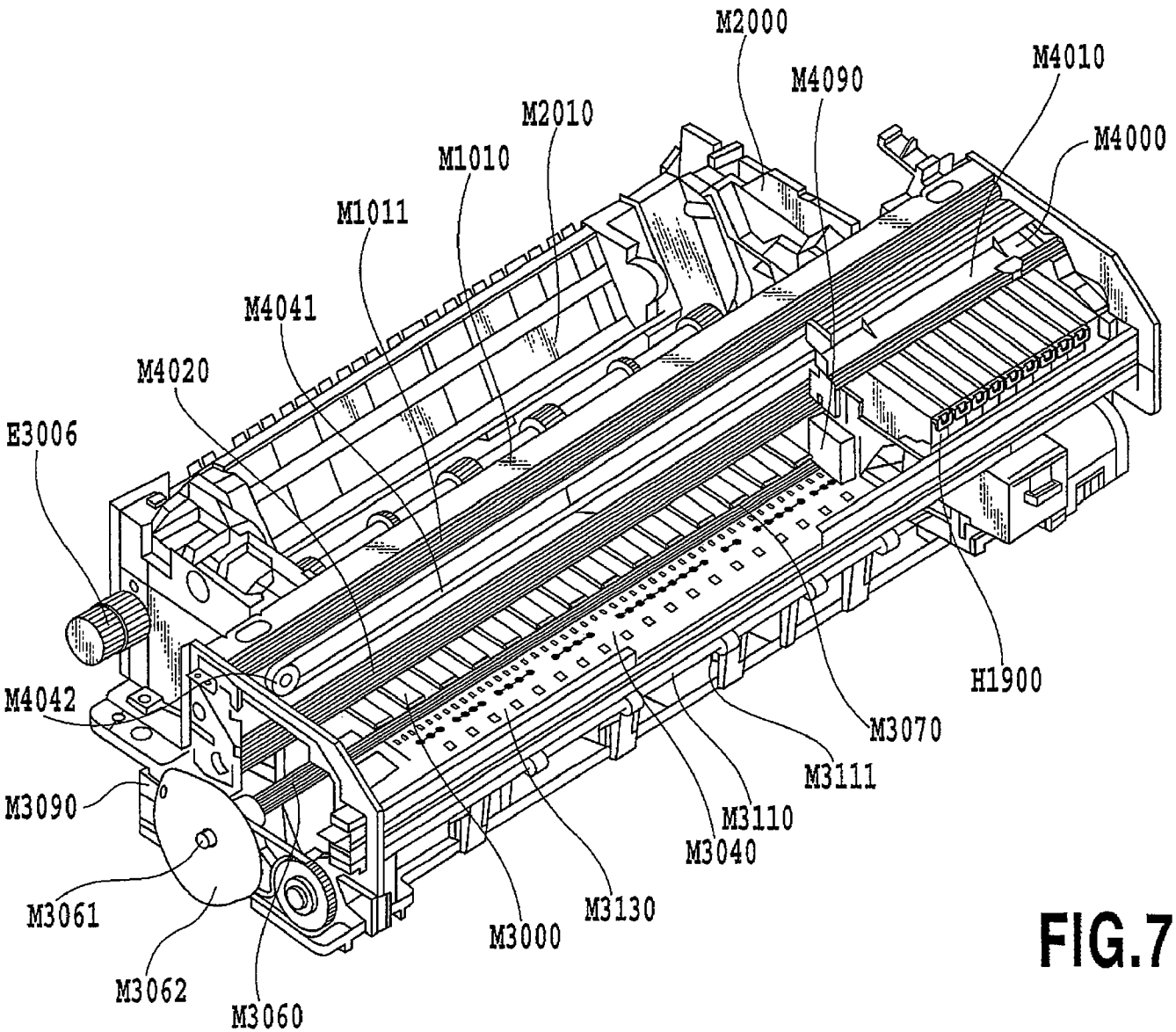
FIG. 7 is a perspective view for explaining the internal mechanism of the main body of the printing apparatus used in the embodiment.
Figure 8:
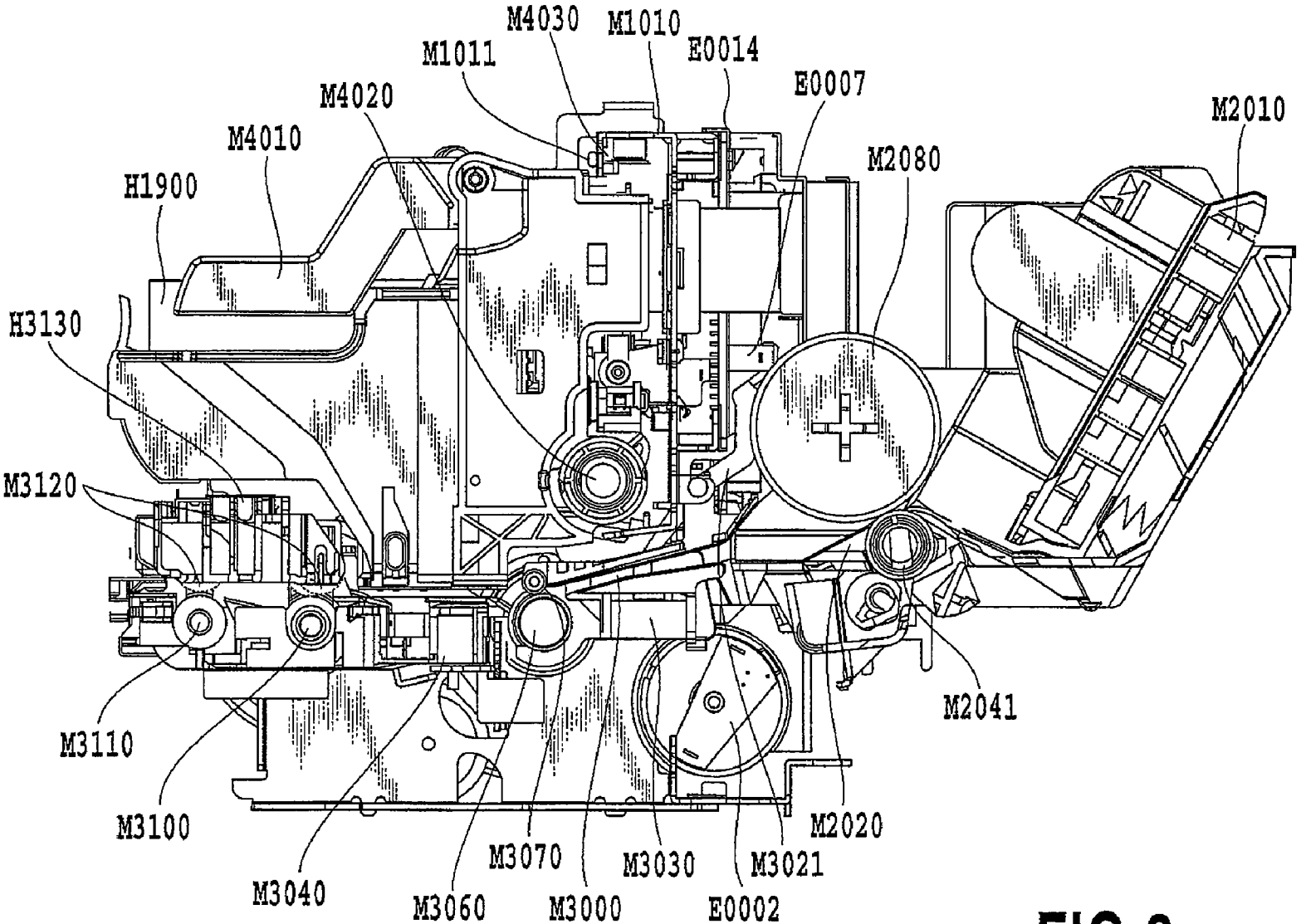
FIG. 8 is a side, sectional view for explaining the internal mechanism of the main body of the printing apparatus used in the embodiment.

FIG. 6 is a perspective view showing appearances of the printing apparatus to which this embodiment is applied. FIGS. 7 and 8 are views for explaining an internal mechanism of the main body of the printing apparatus. FIG. 8 is a side, cross-sectional view of the main body of the printing apparatus.

Descriptions will be provided for each of the sections and the unit one-by-one by referring to these figures whenever deemed necessary.

(A) Outer Case (Refer to FIG. 6)

The outer case is attached to the main body of the printing apparatus in order to cover the paper feeding section, the paper transferring section, the paper delivery section, the carriage section, the cleaning section, the flat-pass section and the wetting liquid transferring unit. The outer case is configured chiefly of a lower case M7080, an upper case M7040, an access cover M7030, a connector cover, and a front cover M7010.

Copy receiving tray rails (not illustrated) are provided under the lower case M7080, and thus the lower case M7080 has a configuration in which a divided copy receiving tray M3160 is capable of being contained therein. In addition, the front cover M7010 is configured to close the paper discharging port while the printing apparatus is not used.

An access cover M7030 is attached to the upper case M7040, and is configured to be turnable. A part of the top surface of the upper case has an opening portion. The printing apparatus has a configuration in which each of ink tanks H1900 and the printing head H1001 (refer to FIG. 11) is replaced with a new one in this position. Incidentally, in the case of the printing apparatus of this embodiment, the printing head H1001 has a configuration in which a plurality of ejection parts are formed integrally into one unit. The plurality of ejection parts corresponding respectively to a plurality of mutually different colors, and each of the plurality of ejection parts is capable of ejecting an ink of one color. In addition, the printing head is configured as a printing head cartridge H1000 which the ink tanks H1900 are capable of being attached to, and detached from, independently of one another depending on the respective colors. The upper case M7040 is provided with a door switch lever (not illustrated), LED guides M7060, a power supply key E0018, a resume key E0019, a flat-pass key E3004 and the like. The door switch lever detects whether the access cover M7030 is opened or closed. Each of the LED guides M7060 transmits, and displays, light from the respective LEDs. Furthermore, a multi-stage paper feeding tray M2060 is turnably attached to the upper case M7040. While the paper feeding section is not used, the paper feeding tray M2060 is contained within the upper case M7040. Thus, the upper case M7040 is configured to function as a cover for the paper feeding section.

The upper case M7040 and the lower case M7040 are attached to each other by elastic fitting claws. A part provided with a connector portion therebetween is covered with a connector cover (not illustrated).

(B) Paper Feeding Section (Refer to FIG. 8)

As shown in FIG. 8, the paper feeding section is configured as follows. A pressure plate M2010, a paper feeding roller M2080, a separation roller M2041, a return lever M2020 and the like are attached to a base M2000. The pressure plate M2010 is that on which printing media are stacked. The paper feeding roller M2080 feeds the printing media sheet by sheet. The separation roller M2041 separates a printing medium. The return lever M2020 is used for returning the printing medium to a stacking position.

(C) Paper Conveying Section (Refer to FIGS. 7 and 8)

A conveying roller M3060 for conveying printing media is rotatably attached to a chassis M1010 made of an upwardly bent plate. A paper end sensor (hereinafter referred to as a "PE sensor") E0007 is also attached to a chassis M1010. The conveying roller M3060 has a configuration in which the surface of a metal shaft is coated with ceramic fine particles. The conveying roller M3060 is attached to the chassis M1010 in a state in which metallic parts respectively of the two ends of the shaft are received by bearings (not illustrated). The conveying roller M3060 is provided with a roller tension spring (not illustrated). The roller tension spring pushes the conveying roller M3060, and thereby applies an appropriate amount of load to the conveying roller M3060 while the conveying roller M3060 is rotating. Accordingly, the conveying roller M3060 is capable of conveying printing media stably.

The conveying roller M3060 is provided with a plurality of pinch rollers M3070 in a way that the plurality of pinch rollers M3070 abut on the conveying roller M3060. The plurality of pinch rollers M3070 move so as to follow the conveying roller M3060. The pinch rollers M3070 are held by a pinch roller holder M3000. The pinch rollers M3070 are pushed respectively by pinch roller springs (not illustrated), and thus are brought into contact with the conveying roller M3060 with the pressure. This generates a force for conveying printing media. At this time, since the rotation shaft of the pinch roller holder M3000 is attached to the bearings of the chassis M1010, the rotation shaft rotates thereabout.

A paper guide flapper M3030 and a platen M3040 are disposed in an inlet to which printing media are conveyed. The paper guide flapper M3030 and the platen M3040 guide the printing media. In addition, the pinch roller holder M3000 is provided with a PE sensor lever M3021. The PE sensor lever M3021 plays a role of informing the PE sensor E0007 of a result of detecting the front end or the rear end of each of the printing medium. The PE sensor E0007 is fixed to the chassis M1010. The platen M3040 is attached to the chassis M1010, and is positioned thereto. The paper guide flapper M3030 is capable of rotating about a bearing unit (not illustrated), and is positioned to the chassis M1010 by abutting on the chassis M1010.

The printing head H1001 (refer to FIG. 13) is provided at a side downstream in a direction in which the conveying roller M3060 conveys printing media.

Descriptions will be provided for a process of conveying printing media in the printing apparatus with the foregoing configuration. A printing medium sent to the paper conveying section is guided by the pinch roller holder M3000 and the paper guide flapper M3030, and thus is sent to a pair of rollers which are the conveying roller 3060 and the pinch roller M3070. At this time, the PE sensor lever M3021 detects an edge of the printing medium. Thereby, a position in which a print is made on the printing medium is obtained. The pair of rollers which are the conveying roller M3060 and the pinch roller M3070 are driven by an LF motor E0002, and are rotated. This rotation causes the printing medium to be conveyed over the platen M3040. A rib is formed in the platen M3040, and the rib serves as a conveyance reference surface. A gap between the printing head H1001 and the surface of the printing medium is controlled by this rib. Simultaneously, the rib also plays a role of suppressing flapping of the printing medium in cooperation with the paper delivery section which will be described later.

A driving force with which the conveying roller M3060 rotates is obtained by transmitting a torque of the LF motor E0002 consisting, for example, of a DC motor to a pulley M3061 disposed on the shaft of the conveying roller M3060 through a timing belt (not illustrated). A code wheel M3062 for detecting an amount of conveyance performed by the conveying roller M3060 is provided on the shaft of the conveying roller M 3060. In addition, an encode sensor M3090 for reading a marking formed in the code wheel M3062 is disposed in the chassis M1010 adjacent to the code wheel M3062. Incidentally, the marking formed in the code wheel M3062 is assumed to be formed at a pitch of 150 to 300 lpi (line/inch) (an example value).

(D) Paper Delivery Section (Refer to FIGS. 7 and 8)

The paper delivery section is configured of a first paper delivery roller M3100, a second paper delivery roller M3110, a plurality of spurs M3120 and a gear train.

The first paper delivery roller M3100 is configured of a plurality of rubber portions provided around the metal shaft thereof. The first paper delivery roller M3100 is driven by transmitting the driving force of the conveying roller M3060 to the first paper delivery roller M3100 through an idler gear.

The second paper delivery roller M3110 is configured of a plurality of elastic elements M3111, which are made of elastomer, attached to the resin-made shaft thereof. The second paper delivery roller M3110 is driven by transmitting the driving force of the first paper delivery roller M3100 to the second paper delivery roller M3110 through an idler gear.

Each of the spurs M3120 is formed by integrating a circular thin plate and a resin part into one unit. A plurality of convex portions are provided to the circumference of each of the spurs M3120. Each of the spurs M3120 is made, for example, of SUS. The plurality of spurs M3120 are attached to a spur holder M3130. This attachment is performed by use of a spur spring obtained by forming a coiled spring in the form of a stick. Simultaneously, a spring force of the spur spring causes the spurs M3120 to abut respectively on the paper delivery rollers M3100 and M3110 at predetermined pressures. This configuration enables the spurs 3120 to rotate to follow the two paper delivery rollers M3100 and M3110. Some of the spurs M3120 are provided at the same positions as corresponding ones of the rubber portions of the first paper delivery roller M3110 are disposed, and at the same positions as corresponding ones of the elastic elements M3111 are disposed. These spurs chiefly play a role of generating a force for conveying printing media. In addition, others of the spurs M3120 are provided at positions where none of the rubber portions and the elastic elements M3111 are provided. These spurs M3120 chiefly play a role of suppressing lift of a printing medium while a print is being made on the printing medium.

Furthermore, the gear train plays a role of transmitting the driving force of the conveying roller M3060 to the paper delivery rollers M3100 and M3110.

With the foregoing configuration, a printing medium on which an image is formed is pinched with nips between the first paper delivery roller M3110 and the spurs M3120, and thus is conveyed. Accordingly, the printing medium is delivered to the copy receiving tray M3160. The copy receiving tray M3160 is divided into a plurality of parts, and has a configuration in which the copy receiving tray M3160 is capable of being contained under the lower case M7080 which will be described later. When used, the copy receiving tray M3160 is drawn out from under the lower case M7080. In addition, the paper delivery tray M3160 is designed to be elevated toward the front end thereof, and is also designed so that the two side ends thereof are held at a higher position. The design enhances the stackability of recording media, and prevents the printing surface of each of the recording media from being rubbed.

(E) Carriage Section (Refer to FIG. 7)

The carriage section includes a carriage M4000 to which the printing head H1001 is attached. The carriage M4000 is supported with a guide shaft M4020 and a guide rail M1011. The guide shaft M4020 is attached to the chassis M1010, and guides and supports the carriage M4000 so as to cause the carriage M4000 to perform reciprocating scan in a direction perpendicular to a direction in which a printing medium is conveyed. The guide rail M1011 is formed in a way that the guide rail M1011 and the chassis M1010 are integrated into one unit. The guide rail M1011 plays a role of holding the rear end of the carriage M4000, and a role of thus maintaining the space between the printing head H1001 and the printing medium. A slide sheet M4030 formed of a thin plate made of stainless steel or the like is stretched on a side of the guide rail M1011, on which side the carriage M4000 slides. This makes it possible to reduce sliding noises of the printing apparatus.

The carriage M4000 is driven by a carriage motor E0001 through a timing belt M4041. The carriage motor E0001 is attached to the chassis M1010. In addition, the timing belt M4041 is stretched and supported by an idle pulley M4042. Furthermore, the timing belt M4041 is connected to the carriage M4000 with a carriage damper made of rubber. Thus, image unevenness is reduced by damping the vibration of the carriage motor E0001 and the like.

An encoder scale E0005 for detecting the position of the carriage M4000 is provided in parallel with the timing belt M4041 (the encoder scale E0005 will be described later by referring to FIG. 9). Markings are formed on the encoder scale E0005 at pitches in a range of 150 lpi to 300 lpi. An encoder sensor E0004 for reading the markings is provided on a carriage board E0013 installed in the carriage M4000 (the encoder sensor E0004 and the carriage board E0013 will be described later by referring to FIG. 9). A head contact E0101 for electrically connecting the carriage board E0013 to the printing head H1001 is also provided to the carriage board E0013. Moreover, a flexible cable E0012 (not illustrated) is connected to the carriage M4000 (the flexible cable E0012 will be described later by referring to FIG. 9). The flexible cable E0012 is that through which a drive signal is transmitted from an electric substrate E0014 to the printing head H1001.

As for configurational elements for fixing the printing head H1001 to the carriage M4000, the following elements are provided to the carriage M4000. An abutting part (not illustrated) and pressing means (not illustrated) are provided on the carriage M4000. The abutting part is with which the printing head H1001 positioned to the carriage M4000 while pushing the printing head H1001 against the carriage M4000. The pressing means is with which the printing head H1001 is fixed at a predetermined position. The pressing means is mounted on a headset lever M4010. The pressing means is configured to act on the printing head H1001 when the headset lever M4010 is turned about the rotation support thereof in a case where the printing head H1001 is intended to be set up.

Moreover, a position detection sensor M4090 including a reflection-type optical sensor is attached to the carriage M4000. The position detection sensor is used while a print is being made on a special medium such as a CD-R, or when a print result or the position of an edge of a sheet of paper is being detected. The position detection sensor M4090 is capable of detecting the current position of the carriage M4000 by causing a light emitting device to emit light and by thus receiving the emitted light after reflecting off the carriage M4000.

In a case where an image is formed on a printing medium in the printing apparatus, the set of the conveying roller M3060 and the pinch rollers M3070 transfers the printing medium, and thereby the printing medium is positioned in terms of a position in a column direction. In terms of a position in a column, the printing medium is positioned by using the carriage motor E0001 to move the carriage M4000 in a direction perpendicular to the direction in which the printing medium is conveyed, and by thus locating the printing head H1001 at a target position where an image is formed. The printing head H1001 thus positioned ejects inks onto the printing medium in accordance with a signal transmitted from the electric substrate E0014. Descriptions will be provided later for details of the configuration of the printing head H1001 and a printing system. The printing apparatus of this embodiment alternately repeats a printing main scan and a sub-scan. During the printing main scan, the carriage M4000 scans in a column direction while the printing head H1001 is making a print. During the sub-scan, the printing medium is conveyed in a row direction by conveying roller M3060. Thereby, the printing apparatus is configured to form an image on the printing medium.

1.3 Configuration of Electrical Circuit

Descriptions will be provided next for a configuration of an electrical circuit of this embodiment.

Figure 9:
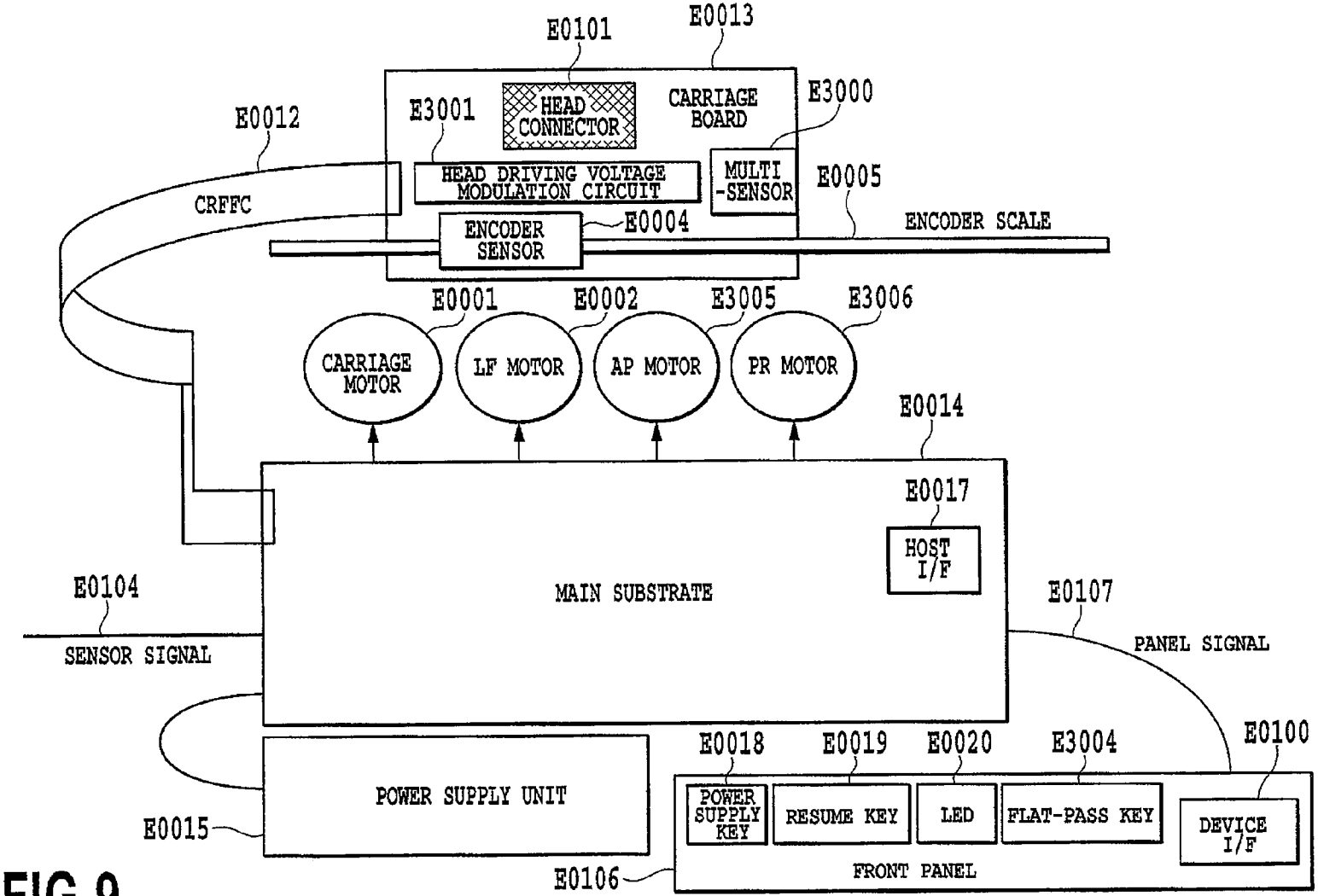
FIG. 9 is a block diagram schematically showing an overall configuration of electric circuits in the embodiment of the present invention.

FIG. 9 is a block diagram for schematically describing the entire configuration of the electrical circuit in the printing apparatus J0013. The printing apparatus to which this embodiment is applied is configured chiefly of the carriage board E0013, the main substrate E0014, a power supply unit E0015, a front panel E0106 and the like.

The power supply unit E0015 is connected to the main substrate E0014, and thus supplies various types of drive power.

The carriage board E0013 is a printed circuit board unit mounted on the carriage M4000. The carriage board E0013 functions as an interface for transmitting signals to, and receiving signals from, the printing head H1001, and for supplying head driving power through the head connector E0101. The carriage board E0013 includes a head driving voltage modulation circuit E3001 with a plurality of channels to the respective ejection parts of the printing head H1001. The plurality of ejection parts corresponding respectively to the plurality of mutually different colors. In addition, the head driving voltage modulation circuit E3001 generates head driving power supply voltages in accordance with conditions specified by the main substrate E0014 through the flexible flat cable (CRFFC) E0012. In addition, change in a positional relationship between the encoder scale E0005 and the encoder sensor E0004 is detected on the basis of a pulse signal outputted from the encoder sensor E0004 in conjunction with the movement of the carriage M4000. Moreover, the outputted signal is outputted to the main substrate E0014 through the flexible flat cable (CRFFC) E0012.

An optical sensor E3010 and a thermistor E3020 are connected to the carriage board E0013, as shown in FIG. 20. The optical sensor E3010 is configured of two light emitting devices (LEDs) E3011 and a light receiving element E3013. The thermistor E3020 is that with which an ambient temperature is detected. Hereinafter, these sensors are referred to as a multisensor system E3000. Information obtained by the multisensor system E3000 us outputted to the main substrate E00014 through the flexible flat cable (CRFFC) E0012.

The main substrate E0014 is a printed circuit board unit which drives and controls each of the sections of the ink jet printing apparatus of this embodiment. The main substrate E0014 includes a host interface (host I/F) E0017 thereon. The main substrate E0014 controls print operations on the basis of data received from a host computer (not illustrated). The main substrate E0014 is connected to various types of motors including the carriage motor E0001, the LF motor E0002, the AP motor E3005 and the PR motor E3006, and thus controls drive of each of the functions. The carriage motor E0001 is a motor serving as a driving power supply for causing the carriage M4000 to perform main scan. The LF motor E0002 is a motor serving as a driving power supply for conveying printing media. The AP motor E3005 is a motor serving as a driving power supply for causing the printing head H1001 to perform recovery operations. The PR motor E3006 is a motor serving as a driving power supply for performing a flat-pass print operation. Moreover, the main substrate E0014 is connected to sensor signals E0104 which are used for transmitting control signals to, and receiving detection signals from, the various sensors such as a PF sensor, a CR lift sensor, an LF encoder sensor, and a PG sensor for detecting operating conditions of each of the sections in the printer. The main substrate E0014 is connected to the CRFFC E0012 and the power supply unit E0015. Furthermore, the main substrate E0014 includes an interface for transmitting information to, and receiving information from a front panel E0106 through panel signals E0107.

The front panel E0106 is a unit provided to the front of the main body of the printing apparatus for the sake of convenience of user's operations. The front panel E0106 includes the resume key E0019, the LED guides M7060, the power supply key E0018, and the flat-pass key E3004 (refer to FIG. 6). The front panel E0106 further includes a device I/F E0100 which is used for connecting peripheral devices, such as a digital camera, to the printing apparatus.

Figure 10:
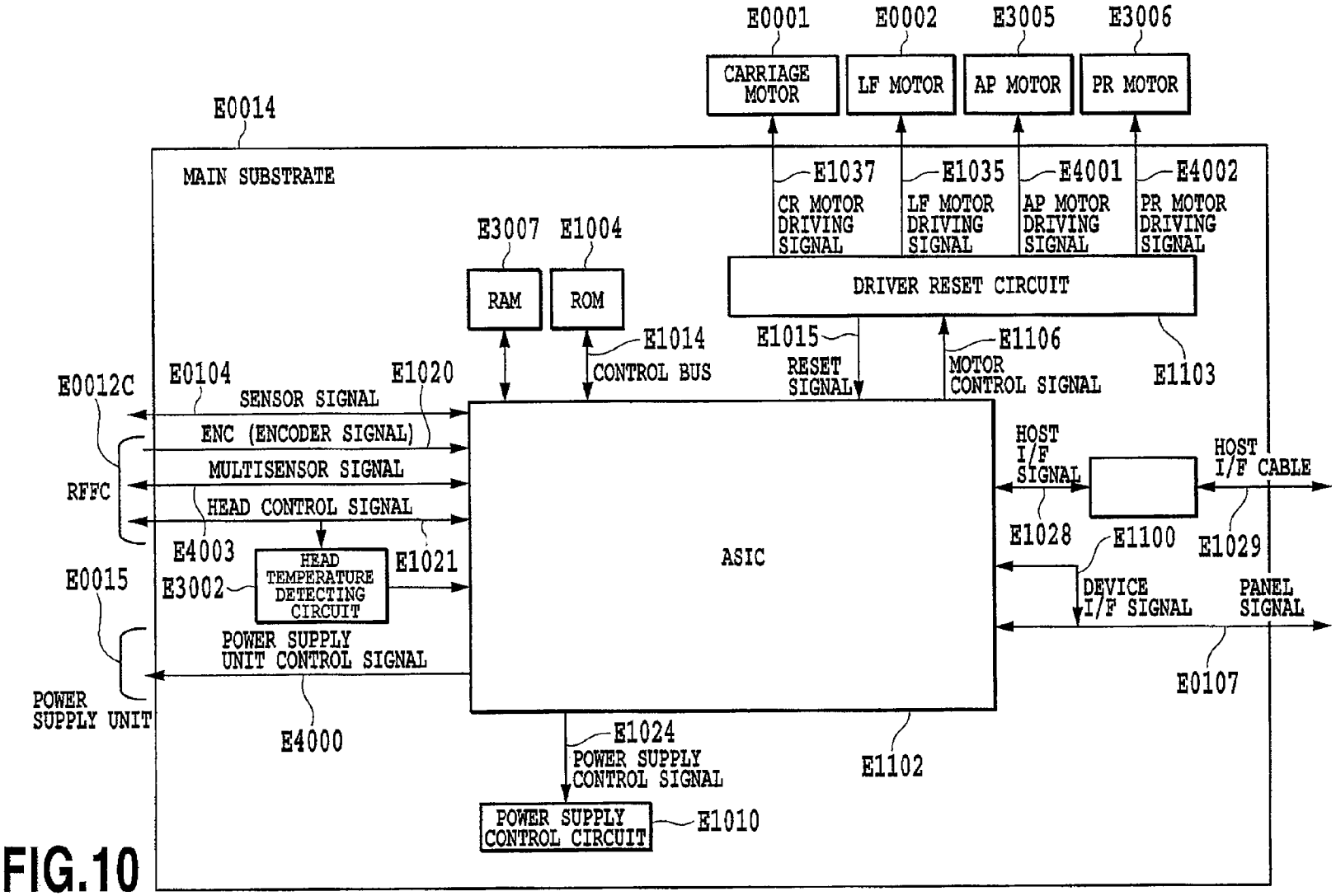
FIG. 10 is a block diagram showing an example of the internal configuration of the main substrate in FIG. 9.

FIG. 10 is a block diagram showing an internal configuration of the main substrate E1004.

In FIG. 10, reference numeral E1102 denotes an ASIC (Application Specific Integrated Circuit). The ASIC E1102 is connected to a ROM E1004 through a control bus E1014. The ASIC E1102 includes a CPU and performs various controls in accordance with programs stored in the ROM E1004. For example, the ASIC E1102 transmits sensor signals E0104 concerning the various sensors and multisensor signals E4003 concerning the multisensor system E3000. In addition, the ASIC E1102 receives sensor signals E0104 concerning the various sensors and multisensor signals E4003 concerning the multisensor system. Furthermore, the ASIC E1102 detects encoder signals E1020 as well as conditions of outputs from the power supply key E0018, the resume key E0019 and the flat-pass key E3004 on the front panel E0106. In addition, the ASIC E1102 performs various logical operations, and makes decisions on the basis of conditions, depending on conditions in which the host I/F E0017 and the device I/F E0100 on the front panel are connected to the ASIC E1102, and on conditions in which data are inputted. Thus, the ASIC E1102 controls the various components, and accordingly drives and controls the ink jet printing apparatus.

Reference numeral E1103 denotes a driver reset circuit. In accordance with motor control signals E1106 from the ASIC E1102, the driver reset circuit E1103 generates CR motor driving signals E1037, LF motor driving signals E1035, AP motor driving signals E4001 and PR motor driving signals E4002, and thus drives the motors. In addition, the driver reset circuit E1103 includes a power supply circuit, and thus supplies necessary power to each of the main substrate E0014, the carriage board E0013, the front panel E0106 and the like. Moreover, once the driver reset circuit E1103 detects drop of the power supply voltage, the driver reset circuit E1103 generates reset signals E1015, and thus performs initialization.

Reference numeral E1010 denotes a power supply control circuit. In accordance with power supply control signals E1024 outputted from the ASIC E1102, the power supply control circuit E1010 controls the supply of power to each of the sensors which include light emitting devices.

The host I/F E0017 transmits host I/F signals E1028, which are outputted from the ASIC E1102, to a host I/F cable E1029 connected to the outside. In addition, the host I/F E0017 transmits signals, which come in through this cable E1029, to the ASIC E1102.

Meanwhile, the power supply unit E0015 supplies power. The supplied power is supplied to each of the components inside and outside the main substrate E0014 after voltage conversion depending on the necessity. Furthermore, power supply unit control signals E4000 outputted from the ASIC E1102 are connected to the power supply unit E0015, and thus a lower power consumption mode or the like of the main body of the printing apparatus is controlled.

The ASIC E1102 is a single-chip semiconductor integrated circuit incorporating an arithmetic processing unit. The ASIC E1102 outputs the motor control signals E1106, the power supply control signals E1024, the power supply unit control signals E4000 and the like. In addition, the ASIC E1102 transmits signals to, and receives signals from, the host I/F E0017. Furthermore, the ASIC E1102 transmits signals to, and receives signals from, the device I/F E0100 on the front panel by use of the panel signals E0107. As well, the ASIC E1102 detects conditions by means of the sensors such as the PE sensor and an ASF sensor with the sensor signals E0104. Moreover, the ASIC E1102 controls the multisensor system E3000 with the multisensor signals E4003, and thus detects conditions. In addition, the ASIC E1102 detects conditions of the panels signals E0107, and thus controls the drive of the panel signals E0107. Accordingly, the ASIC E1102 blinks the LEDs E0020 on the front panel.

The ASIC E1102 detects conditions of the encoder signals (ENC) E1020, and thus generates timing signals. The ASIC E1102 interfaces with the printing head H1001 with head control signals E1021, and thus controls print operations. In this respect, the encoder signals (ENC) E1020 are signals which the ASIC E1102 receives from the CRFFC E0012, and which have been outputted from the encoder sensor E0004. In addition, the head control signals E1021 are connected to the carriage board E0013 through the flexible flat cable E0012. Subsequently, the head control signals E1021 are supplied to the printing head H1001 through the head driving voltage modulation circuit E3001 and the head connector E0101. Various types of information from the printing head H1001 are transmitted to the ASIC E1102. Signals representing information on head temperature of each of the ejection parts among the types of information are amplified by a head temperature detecting circuit E 3002 on the main substrate, and thereafter the signals are inputted into the ASIC E1102. Thus, the signals are used for various decisions on controls.

In the figure, reference numeral E3007 denotes a DRAM. The DRAM E3007 is used as a data buffer for a print, a buffer for data received from the host computer, and the like. In addition, the DRAM is used as work areas needed for various control operations.

1.4 Configuration of Printing Head

Descriptions will be provided below for a configuration of the head cartridge H1000 to which this embodiment is applied.

The head cartridge H1000 in this embodiment includes the printing head H1001, means for mounting the ink tanks H1900 on the printing head H1001, and means for supplying inks from the respective ink tanks H1900 to the printing head H1001. The head cartridge H1000 is detachably mounted on the carriage M4000.

Figure 11:
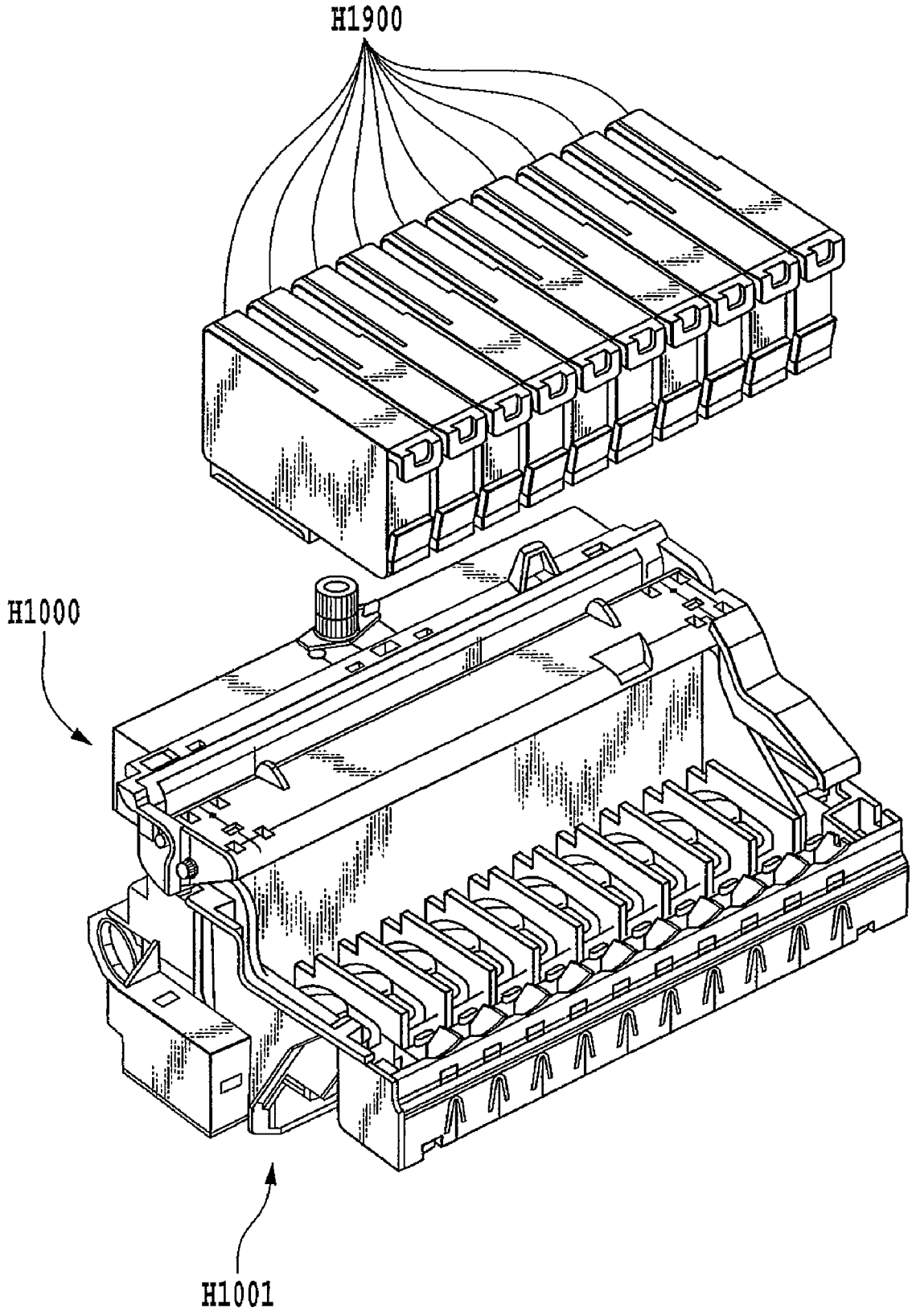
FIG. 11 is a perspective view showing an aspect of installing ink tanks into a head cartridge applied to the embodiment.
Figure 13:
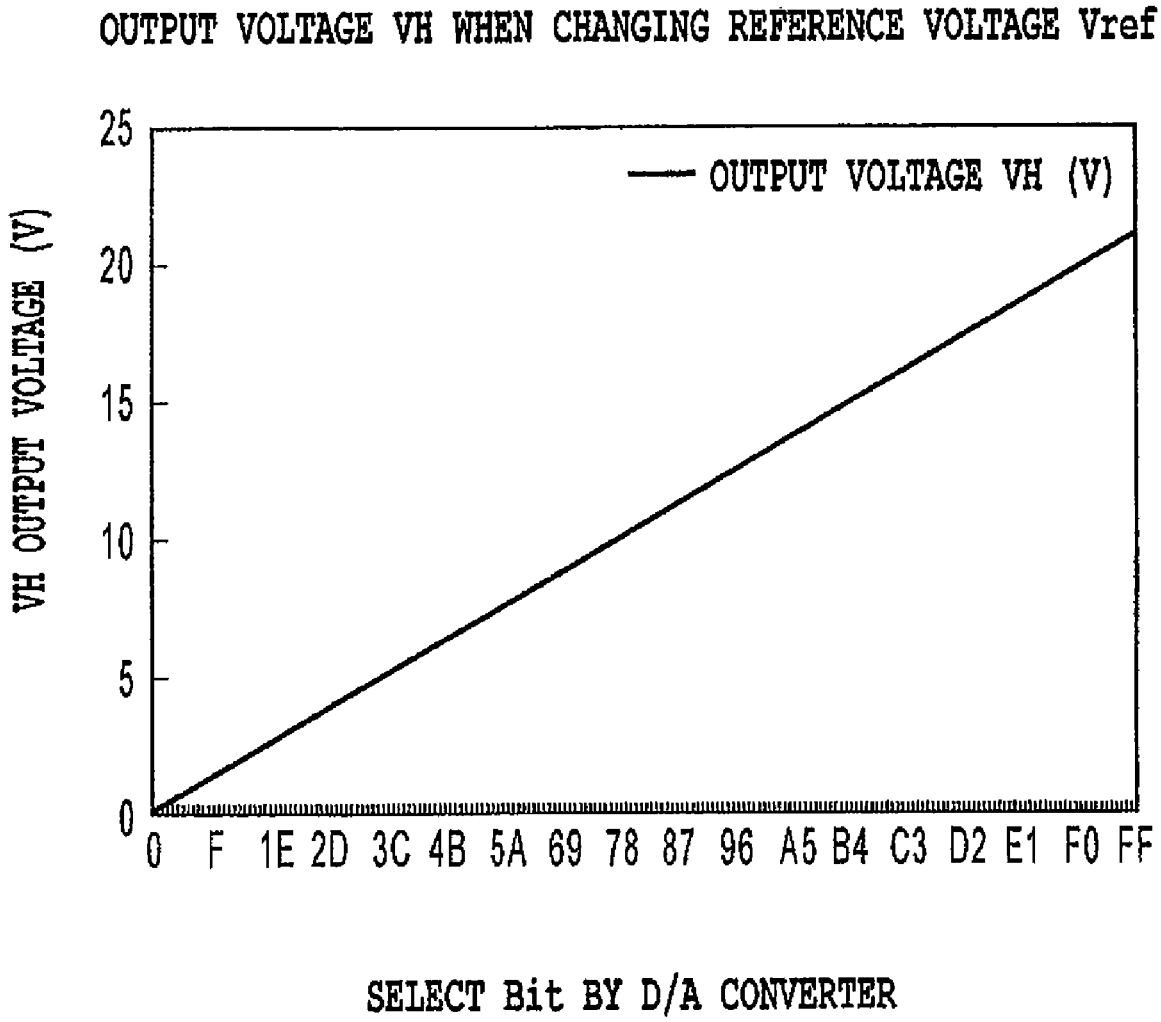
FIG. 13 is a graph for explaining an output voltage from the DC/DC converter in FIG. 12.

FIG. 11 is a diagram showing how the ink tanks H1900 are attached to the head cartridge H1000 to which this embodiment is applied. The printing apparatus of this embodiment forms an image by use of the pigmented inks corresponding respectively to the ten colors. The ten colors are cyan (C), light cyan (Lc), magenta (M), light magenta (Lm), yellow (Y), black 1 (K1), black 2 (K2), red (R), green (G) and gray (Gray). For this reason, the ink tanks H1900 are prepared respectively for the ten colors. As shown in FIG. 13, each of the ink tanks can be attached to, and detached from, the head cartridge H1000. Incidentally, the ink tanks H1900 are designed to be attached to, and detached from, the head cartridge H1000 in a state where the head cartridge H1000 is mounted on the carriage M4000.

The printing head H1001 includes a heater (an electrothermal converter) located inside the ink passage communicating with the ink ejection port, and the ink is ejected by use of the energy generated by the heater. That is to say, the ink inside the ink passage is foamed by application of the drive voltage to the heater to cause heat generation, and the ink is ejected from the ink ejection port by use of the foaming energy.

2. Characteristic Configuration

Next, a concrete example of a characteristic configuration of the present invention will be described.

(First Example of Head-Drive-Voltage-Modulation Circuit)

Figure 12:
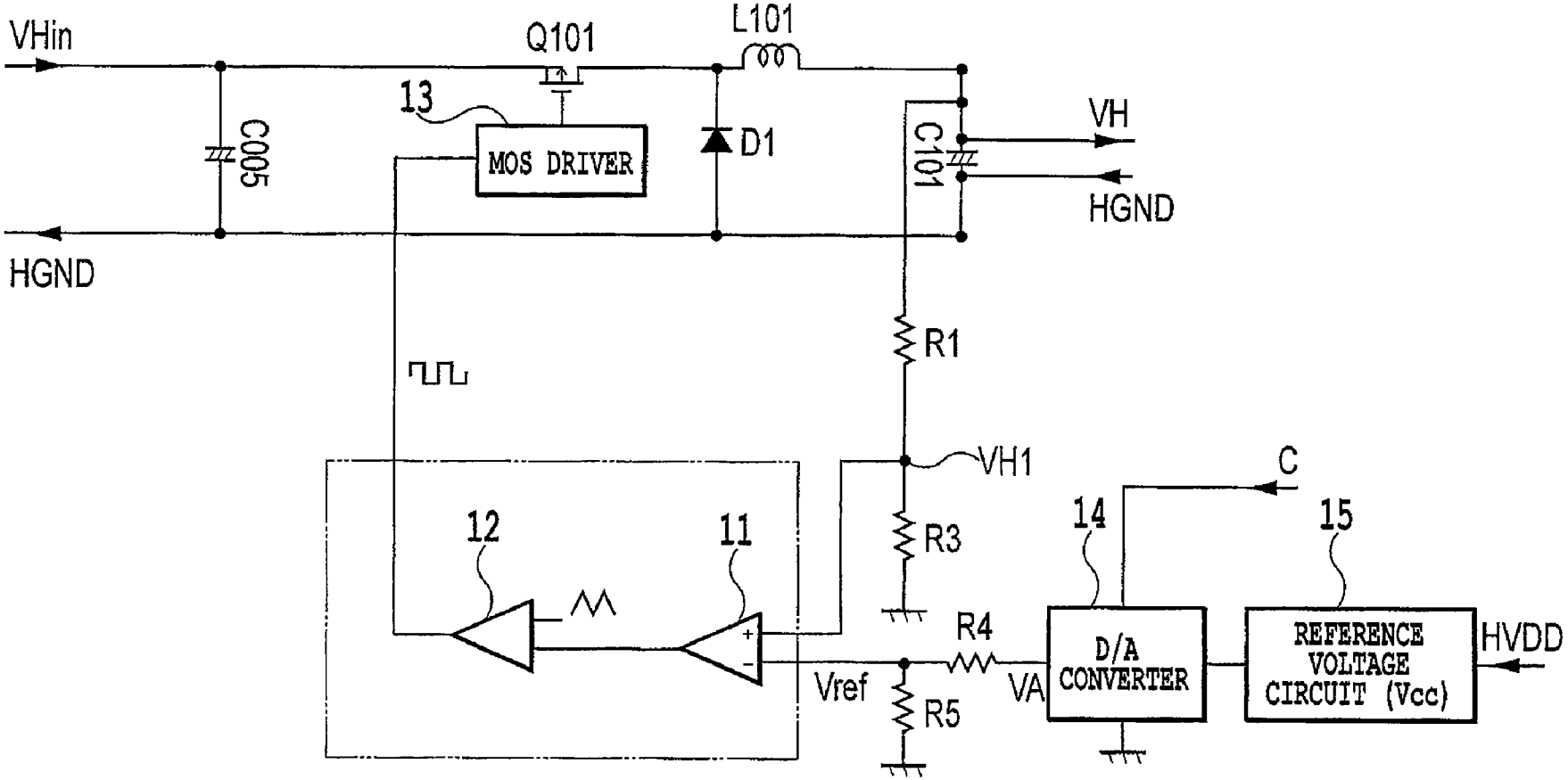
FIG. 12 is a circuit diagram for explaining an example of a DC/DC converter included in a head-drive-voltage-modulation circuit in FIG. 9.

FIG. 12 is a circuit diagram for explaining a first example of a concrete configuration of the head-drive-voltage-modulation circuit E3001 on the carriage board E0013.

The head-drive-voltage-modulation circuit E3001 receives an input voltage VHin from the power supply unit E0015 and outputs an output voltage VH to be applied to a heater (an electrothermal converter) of the printing head to be described later. This head-drive-voltage-modulation circuit E3001 includes a DC/DC converter for controlling the output voltage VH. The DC/DC converter compares a divided voltage of the output voltage VH with a reference voltage Vref by use of an error amplifier (Error Amp) 11, and controls the output voltage VH so as to eliminate the error between these values. The reference voltage Vref is inputted to one of input terminals (an inverting terminal) of the error amplifier 11, while a divided voltage value VH1 of the output voltage VH divided in accordance with the following formula by resistors R1 and R3 is putted to the other input terminal (a noninverting terminal).

$$VH1 = VH \times \frac{R3}{R1 + R3}. \quad \text{(Formula 1)}$$

The reference voltage Vref is compared with the divided voltage value VH1 by the error amplifier 11, and an output from the error amplifier 11 corresponding to the difference between these values is inputted to a comparator 12. The comparator 12 outputs a signal having a pulse width corresponding to the difference between the reference voltage Vref and the divided voltage value VH1 to a MOS driver 13, and the driver 13 activates a switching element Q101 based on that signal. Reference numerals L101 and C101 respectively denote at inductance and a reactance constituting a smoothing circuit.

As described above, the switching element Q101 is subjected to PWM control in response to the difference between the reference voltage Vref and the divided voltage value VH1. As a result, the output voltage VH is maintained at a constant voltage corresponding to the reference voltage Vref.

In this example, the reference voltage Vref to be inputted to the error amplifier 11 is controlled by a D/A converter 14 in order to change the output voltage VH with the above-described DC/DC converter. The D/A converter 14 uses a reference voltage Vcc generated by a reference voltage circuit 15 as a reference, and controls the reference voltage Vref as a target voltage based on a digital signal (a control signal) C to be described later. This control signal C is generated by an ASIC provided on the main substrate. For example, when the control signal C is an 8-bit digital signal, it is possible to adjust an output from the D/A converter 14 into 256 levels. In this case, assuming that an input voltage to the D/A converter 14 is Vcc and a value of the 8-bit control signal C is Xbit, an output voltage VA from the D/A converter 14 is expressed by the following formula.

$$VA = \frac{Vcc}{2^8} \times Xbit \quad \text{(Formula 2)}$$

Therefore, the output voltage VH1 is expressed by the following formula.

$$\begin{aligned} VH1 &= Vref \times \frac{R1 + R3}{R3} \\ &= \frac{Vcc}{2^8} \times Xbit \times \frac{R1 + R3}{R3} \times \frac{R5}{R4 + R5} \end{aligned} \quad \text{(Formula 3)}$$

Here, resistors R4 and R5 are voltage dividing resistors configured to bring the output voltage VA within a common-mode-input-voltage range of the error amplifier 11.

FIG. 13 is a correlation diagram between selected values of the 8-bit control signal C and the values of the output voltage VH. In this example, when the selected value of the control signal C is increased, the output voltage VA from the D/A converter 14 and the reference voltage Vref to be applied to the inverting terminal of the error amplifier 11 are increased. As a result, the value of output voltage VH is increased.

(Second Example of Head-Drive-Voltage-Modulation Circuit)

Figure 14:
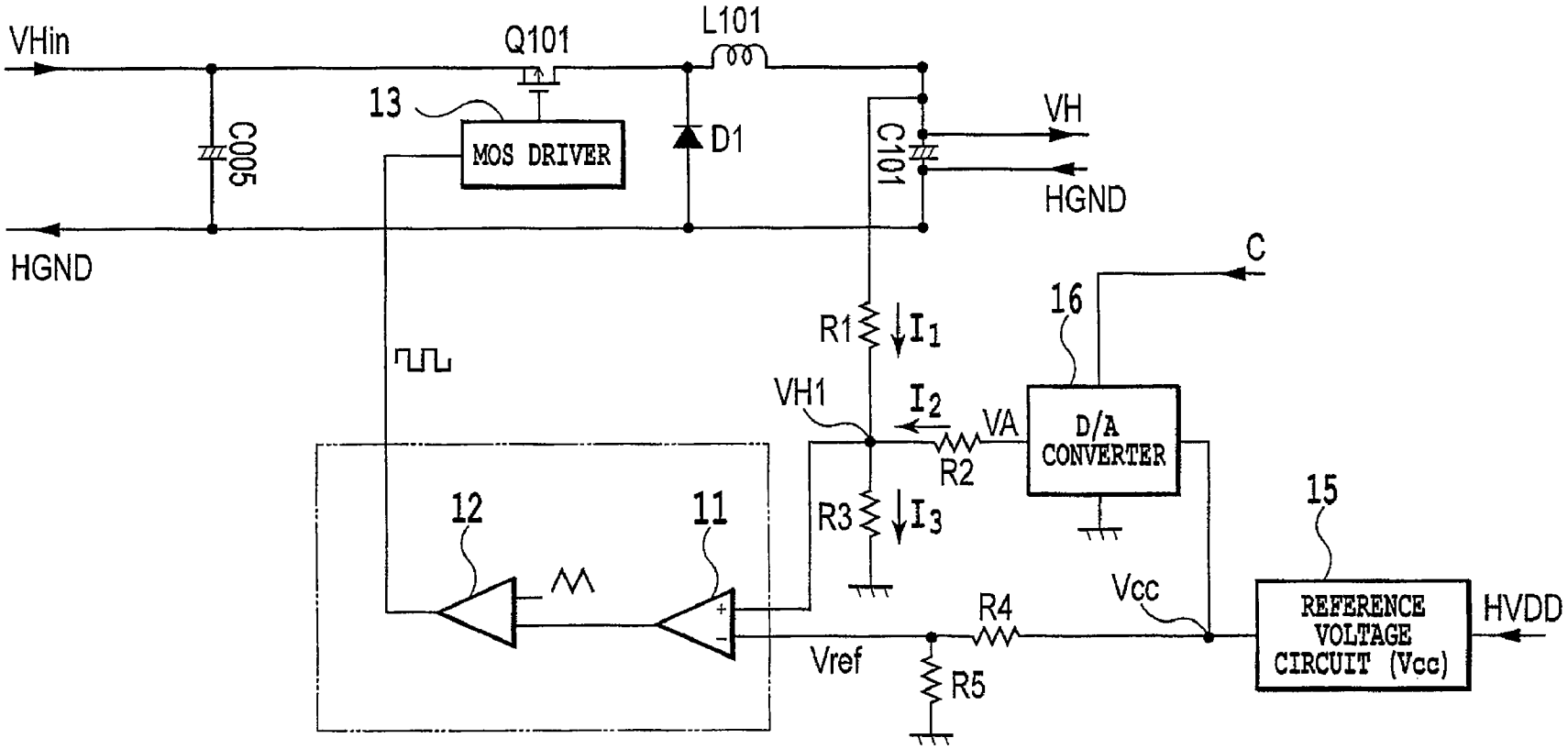
FIG. 14 is a circuit diagram for explaining another example of the DC/DC converter included in the head-drive-voltage-modulation circuit in FIG. 9.

FIG. 14 is a circuit diagram for explaining a second example of the concrete configuration of the head-drive-voltage-modulation circuit E3001 on the carriage board E0013.

In this example, an electric current is applied to a voltage dividing point of the output voltage VH by use of a D/A converter 16 in order to change the output voltage VH. The D/A converter 16 inputs the reference voltage Vcc generated by the reference voltage circuit 15 and outputs the output voltage VA corresponding to the control signal (the digital signal) C to be described later. In this way, an electric current I2 corresponding to the output voltage VA is applied to the voltage dividing point of the resistors R1 and R3 through a resistor R2. For example, when the control signal C is an 8-bit digital signal, it is possible to adjust the output from the D/A converter 16 into 256 levels. In this case, assuming that an input voltage to the D/A converter 16 is Vcc and a value of the 8-bit control signal C is Xbit, the output voltage VA from the D/A converter 16 is expressed by the following formula.

$$VA = \frac{Vcc}{2^8} \times Xbit \quad \text{(Formula 4)}$$

As the electric current I2 corresponding to this output voltage VA is added to the voltage dividing point of the resistors R1 and R3, the output voltage is changed as described below.

The voltage VH1 to be inputted to the noninverting terminal of the error amplifier 11 is controlled so as to eliminate the error relative to the reference voltage Vref to be inputted to the inverting terminal. Therefore, electric currents I1, I2, and I3 flowing through the respective resistors R1, R2, and R3 are expressed by the following formulae.

$$I_1 = \frac{VH - Vref}{R1} \quad I_2 = \frac{VA - Vref}{R2} \quad I_3 = \frac{Vref}{R3} \quad \text{(Formulae 5)}$$

The following formulae hold true according to Kirchhoff's current law.

$$I_1 + I_2 = I_3 \quad \frac{VH - Vref}{R1} + \frac{VA - Vref}{R2} = \frac{Vref}{R3} \quad \text{(Formulae 6)}$$

Therefore, the output voltage VH is expressed by the following formulae.

$$\begin{aligned} VH - Vref &= R1\left\{\frac{Vref}{R3} - \frac{(VA - Vref)}{R2}\right\} \\ VH &= Vref + R1\left\{\frac{Vref}{R3} + \frac{Vref - VA}{R2}\right\} \end{aligned} \quad \text{(Formulae 7)}$$

In this way, it is possible to adjust the output voltage VH by controlling the output voltage value VA from the D/A converter 16.

Figure 15:
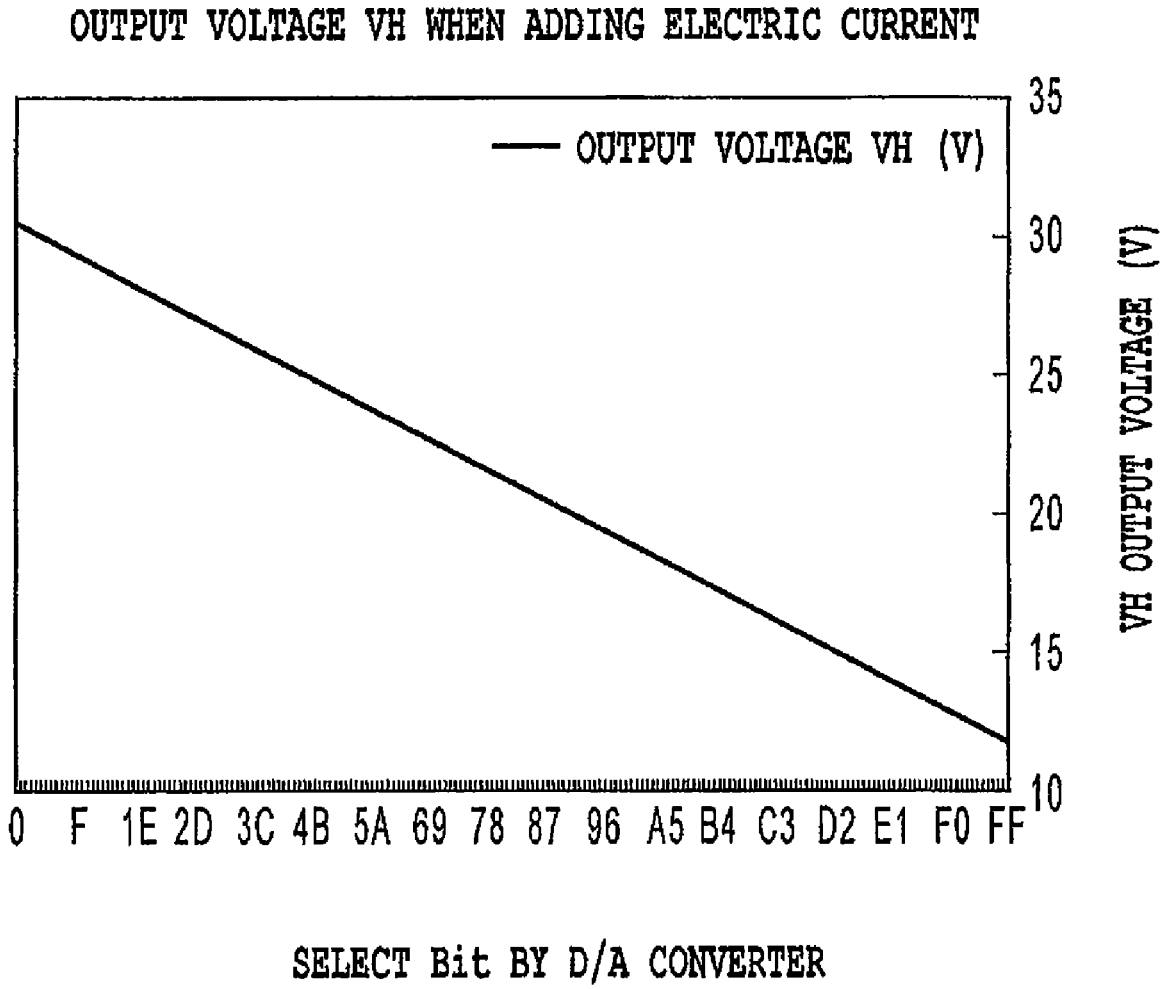
FIG. 15 is a graph for explaining an output voltage from the DC/DC converter in FIG. 14.

FIG. 15 is a correlation diagram between selected values of the 8-bit control signal C and the output voltage VH. In this example, the output voltage VA from the D/A converter 16 becomes larger along with the increase in the selected value of the control signal C. As a result, the electric current I2 flowing through the resistor. R2 is increased. Here, since the relation among the electric current values is expressed as I1+I2=I3, the electric current I1 flowing through the resistor R1 is decreased in response to the increase in the electric current I2. Moreover, since the electric current I1 is decreased, the output voltage VH is reduced as a consequence. In other words, the circuit shown in FIG. 14 constitutes a feedback control circuit that reduces the voltage VH in response to the increase in the electric current I2 flowing through the resistor R2.

(Relation Between Drive Voltage and Amount of Ink Ejection)

Figure 16:
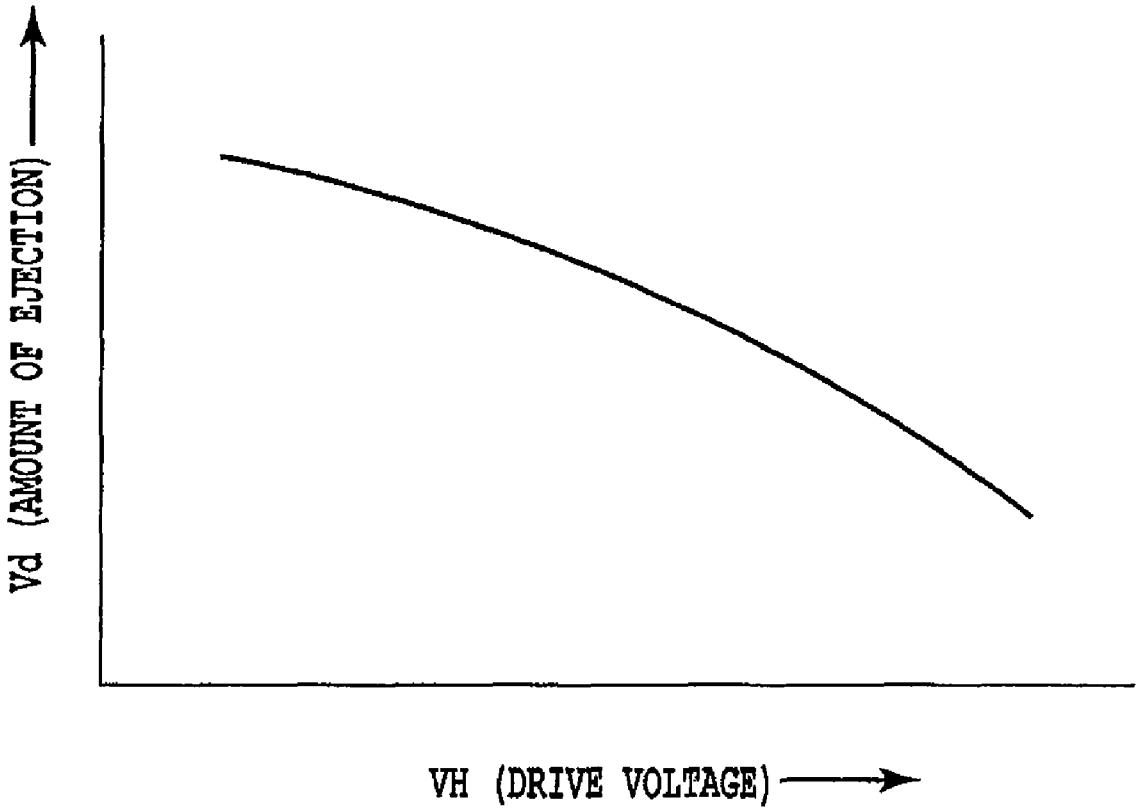
FIG. 16 is a graph for explaining relation between the drive voltage to a heater and the amount of ink ejection.

FIG. 16 shows a variation in the ejecting amount of ink (Vd) at the time when the drive voltage (VH) to be applied as a pulse to the heater of the printing head is changed. Drive energy to be applied to the heater is adjusted by use of the drive voltage VH and the pulse width. In this example, the drive voltage VH is adjusted so as to maintain a value k equal to 1.15 whenever the drive energy necessary for ink ejection is applied.

Here, the value k will be explained, firstly. The ink jet printing head has a predetermined energy threshold of the drive energy necessary for ejecting ink (ejection energy). The ink is not foamed or ejected until the drive energy exceeds that energy threshold. Factors for adjusting the drive energy to be applied to the heater include the drive voltage and the pulse width. In the case of applying predetermined drive energy, the drive voltage and the pulse width satisfy a relation that one of the factors is increased when the other is decreased. Here, in the case of changing the drive voltage with the pulse width being fixed to a predetermined value, a voltage threshold corresponding to a boundary of whether the ink is ejected or not is defined as Vth. When driving the ink jet printing head using this threshold Vth as a reference, the ink ejection may not be sufficiently stable because of the fluctuation of a surface property of the heater and the like. Therefore, a drive voltage Vop which is larger than the threshold Vth will be applied in order to eject ink. For this reason, the drive voltage VH is set up by multiplying the threshold Vth by a certain value, and that certain value is referred to as the value k. That is, an equation "drive voltage VH=value k×threshold Vth" holds true. The drive voltage VH corresponds to the amount of drive energy to be applied to the heater for stably ejecting ink while the pulse width is fixed to the predetermined value.

The drive energy is equivalent to the multiplied value of the drive voltage and the pulse width, and the threshold Vth is equal to the drive voltage at the time when the drive energy corresponding to the energy threshold is applied. Therefore, when the drive energy corresponding to the energy threshold is applied, the threshold Vth becomes smaller when the pulse width is increased, and the threshold Vth becomes greater when the pulse width is decreased.

When the value k is actually found, a printing operation is, firstly, performed on a printing medium by changing the drive voltage while the pulse width of the drive pulse applied to the ink jet printing head is fixed to a predetermined value. Then, the threshold (Vth) of the drive voltage is obtained by observing whether or not ink droplets ejected from the printing head landed the printing medium. Thereafter, the value k can be obtained by calculating (the drive voltage capable of stably ejecting the ink)/(Vth). This value k can be obtained for the entire ink jet printing head or for every predetermined number of heaters.

This value k corresponds to the amount of the drive energy applied to the heater in order to eject ink stably. Keeping the value k constant is equivalent to maintaining the drive energy to a constant level by adjusting the two interrelated values of the drive voltage and of the pulse width.

What the above experiment proved is that the amount of ink ejection is reduced as shown in FIG. 16 when the drive voltage is raised in association with the pulse width with the value k being kept a constant 1.15. This is because raising the drive voltage reduces the pulse width, which results in a shorter time period for transmission of the heat from the heater to the ink. In other words, a portion of an ink layer (a high temperature layer) being heated to a high temperature and contributing to ink foaming becomes thinner. This makes a volume of a bubble upon ink foaming smaller, and thus reduces the amount of ink ejection.

(Relation Between Base Temperature and Amount of Ink Ejection)

Figure 17:
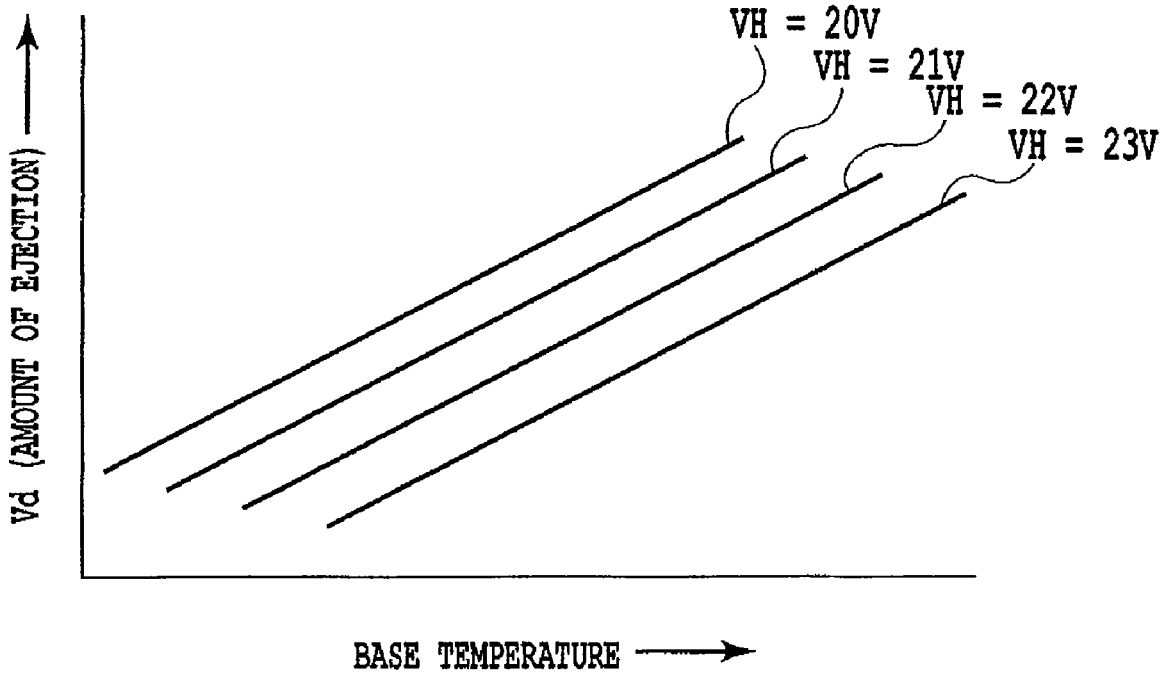
FIG. 17 is a graph for explaining relations between the base temperature and the amount of ink ejection for different values of drive voltage.

FIG. 17 shows a relation between the temperature (base temperature) of a base member constituting the printing head and the amount Vd of ink ejection. The base member, provided with the heater and the like, has the ink passage being formed thereon. The temperature of this base member (base temperature) corresponds to the temperature of the ink inside the printing head. This base temperature may be affected by the temperature environment around the printing head or by self heating of the printing head that reiterated printing operations bring about.

Figure 18:
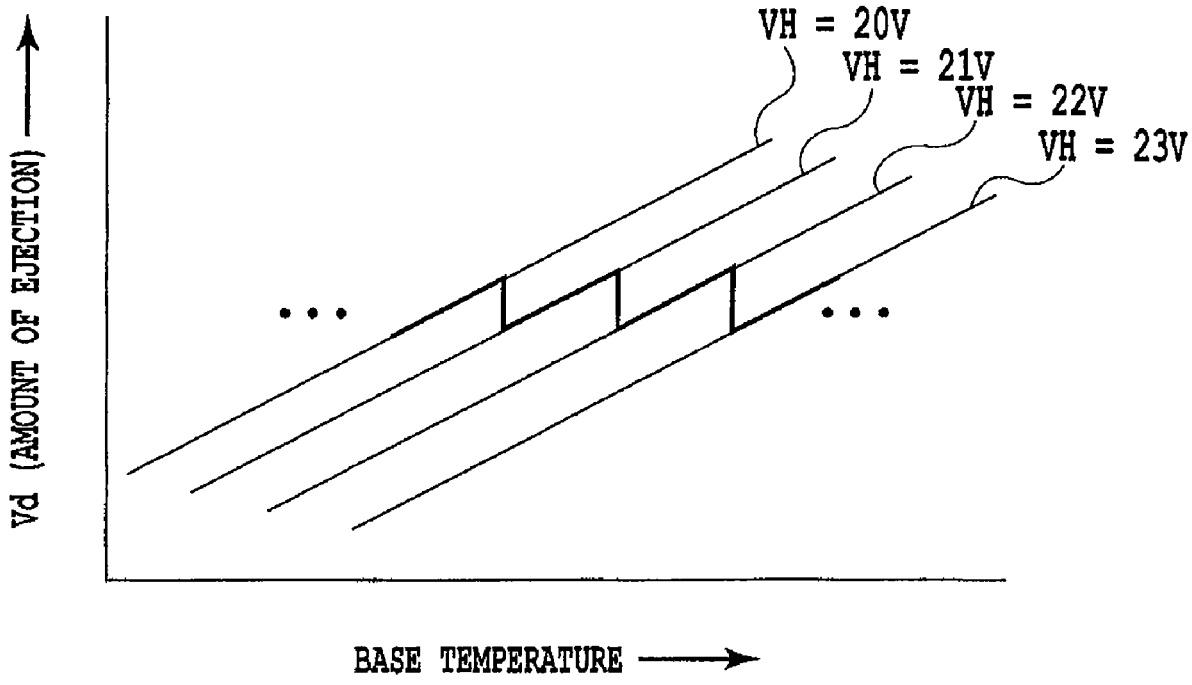
FIG. 18 is a graph for explaining an example of controlling the heater in the embodiment of the present invention.

Thermal energy generated by the heater inside the printing head expands a portion of a high temperature layer of the ink, transferring the heat to the ink in the vicinity of the heater. The same amount of thermal energy generated by the heater, when combined with a low-temperature ink inside the printing head, produces a thinner portion of the high temperature-layer portion that contributes to foaming, and, when combined with a high-temperature ink, produces a thicker portion of the high-temperature layer. As a result, the amount of ink ejection Vd is changed as shown in FIG. 18 in response to the base temperature of the printing head. Such phenomenon as shown in FIG. 18 was confirmed through the above experiment.

(Drive Control of Heater Based on Base Temperature)

In this embodiment, the amount of ink ejection is kept constant by use of the phenomena shown in FIG. 16 and FIG. 17. Specifically, as shown in FIG. 18, on condition that constant drive energy is applied to the heater, a rise of the base temperature of the printing head brings about a rise in the drive voltage VH. A rise in the drive voltage VH brings about a reduction in the pulse width. Thus, the higher the base temperature is, the shorter the time period for transmission of the heat of the heater becomes and the thinner the thickness of the portion of the ink layer (the high temperature layer) contributing to foaming becomes. Consequently, the amount of ink ejection can be kept constant.

In this example, the driving condition of the heater is changed in the course of printing in order to stabilize, with high precision, the amount of ink ejection that varies continually in the course of printing. Specifically, when the printing head scans moving to and fro on the printing medium for printing, the base temperature of the printing head is detected by use of a temperature sensor such as a diode sensor upon completion of every scanning operation of the printing head. The diode sensor is disposed on a heater board (the base member) on which the heater is also disposed. Sometimes the temperature sensor such as the diode sensor has difficulty in detecting an accurate temperature of the heater of the printing head in operation as the sensor is susceptible to noises. For this reason, the base temperature is detected on completion of every scanning operation of the printing head. On the basis of the base temperature thus detected, the drive voltage and the drive pulse are controlled.

(Unevenness in Characteristics of Heaters (Heater Rank))

Next, unevenness in the characteristics of the heaters of the printing head will be described.

The heater of the printing head, having a thinner heater film (an electric resistance layer), has particularly increased fluctuation in the resistance value. This may produce differences among heaters in the energy threshold needed for the heater to eject ink. Plural heaters having characteristics different from one another, even when the same drive voltage is applied thereto in an attempt to eject ink, render each pulse width of the drive pulse different from one another, and ink is ejected from each printing head in different amount from one another.

Fluctuation in the amount of ink ejection can be suppressed by the divided double-pulse-drive control over the printing head in which the pre-heat pulse width is adjusted on the basis of the heater rank.

In the double-pulse-drive control, a predetermined drive voltage (VH) pulse is applied to the heater in two divided pulses as shown in FIG. 29. The first is the pre-heat pulse, which causes the heater to generate heat to adjust the ink temperature in the ink passage, but not enough to eject ink. The second is the main heat pulses which causes the heater to generate enough heat to eject ink. It is possible to stabilize the amount of ink ejection by adjusting a pulse width P1 of the pre-heat pulse, a pulse width P3 of the main heat pulse, and an interval P2 of these pulses (interval time). For example, the pulse width P1 of the pre-heat pulse is adjusted to be relatively long in the case where the low base temperature of the printing head would otherwise make the amount of ink ejection less than necessary. On the other hand, the pulse width P1 of the pre-heat pulse is adjusted to be relatively short in the case where the high base temperature of the printing head would otherwise make the amount of ink ejection more than necessary.

In the case of performing the single-pulse-drive control over the printing head, only the main heat pulse is applied as the drive pulse for the heater, without applying the pre-heat pulse. Accordingly, in the case of the single-pulse-drive control, the pulse width of the drive pulse is automatically determined depending on the drive voltage VH on condition that constant drive energy is applied to the heater. Thus, it is not possible to control the amount of ink ejection.

Figure 19:
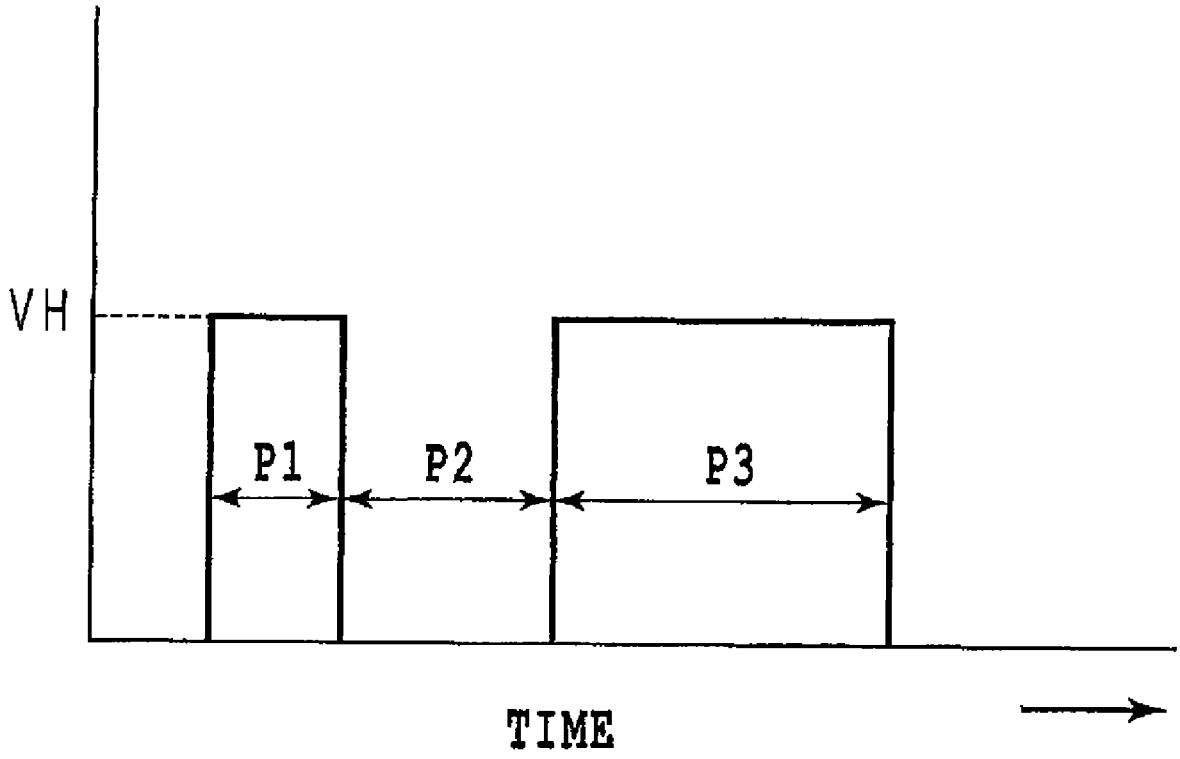
FIG. 19 is a graph for explaining drive pulses used in double-pulse-drive control.

In the case of the double-pulse-drive control as shown in FIG. 19, the drive pulse includes the pre-heat pulse, the interval, and the main heat pulse. This control method, therefore, requires a longer period for one shot of ink ejection than in the case of the single-pulse-drive control. There has been a growing demand for speeding up further the ink jet printing apparatuses in recent years. To this end, it is favorable to shorten the time period required for every ejection of ink as much as possible. With a single-pulse-drive control which is capable of keeping the amount of ink ejection constant, faster printing and stabilization of the amount of ink ejection can be achieved at the same time.

FIRST EXAMPLE OF DRIVE CONTROL OF HEATER

In this embodiment, a drive table as shown in FIG. 20 is used for simultaneously correcting the fluctuation in the amount of ink ejection attributable to the variation in the base temperature of the printing head and the fluctuation therein attributable to the heater rank (unevenness in the characteristic of the heater). By using this drive table, the heater is subjected to the double-pulse-drive control and to the single-pulse-drive control depending on the base temperature and the heater rank. That is, a base temperature at which the double-pulse-drive control and the single-pulse-drive control are switched is different depending on the heater rank (information on the character of the heater).

When using the drive table shown in FIG. 20, the heater rank of the heater of the printing head is firstly selected, and then the drive pulse of the heater in the selected heater rank is determined depending upon the base temperature of the printing head. A heater in the lowest heater rank (rank Min) has the lowest threshold of the drive energy necessary for ink ejection because of a large heat quantity per unit time, i.e. a large heat flux, to be transmitted from the heater to the ink. In other words, the "rank Min" heater requires the shortest time period from application of the drive pulse to ink ejection. In contrast, a heater in the highest heater rank (rank Max) has the highest threshold of the drive energy necessary for ink ejection because of a small heat quantity per unit time, i.e. a small heat flux, to be transmitted from the heater to the ink. In other words, the "rank Max" heater requires the longest time period from application of the drive pulse to ink ejection. A "rank medium" heater is in a heater rank of a medium level.

Figure 21:
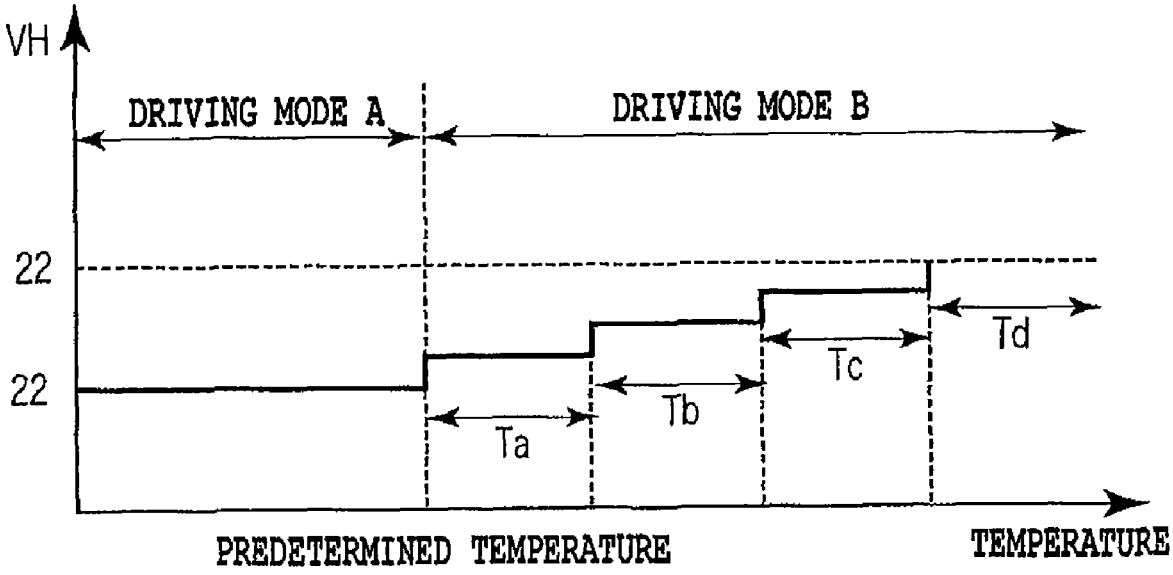
FIG. 21 is a graph for explaining relation among the base temperature, driving modes, and drive voltage in the embodiment of the present invention.

A supplemental description of the drive table shown in FIG. 20 will be with referring to FIG. 21. FIG. 21 graphically depicts a relation ship among the base temperature, driving modes, and a drive voltage in a heater rank.

When the base temperature (temperature of the printing head) is lower than a predetermined temperature i.e. is in a temperature range under the predetermined temperature (driving mode A), the heater is driven under the double-pulse-drive control. On the other hand (driving mode B), when the base temperature is equal to or higher than the predetermined temperature, the heater is driven under the single-pulse-drive control.

Moreover, when the base temperature is equal to or higher than the predetermined temperature, the drive voltage for printing varied depending upon each temperature range. In FIG. 21, when the base temperature is in a temperature range Tb higher than a temperature range Ta, the drive voltage VH is increased. For example, the drive voltage VH corresponding to the temperature range Ta is 20.5 volts, and the drive voltage VH corresponding to the temperature range Tb is 21 volts. For the pulse width, for example, pulse width P3 corresponding to the temperature range Ta is 0.78 μs, in which case pulse width P1 is 0 μs, and pulse width P3 corresponding to the temperature range Tb is 0.76 μs, in which case pulse width P1 is 0 μs. In this example, for the purpose of simplification, each of temperature ranges (Ta, Tb, Tc, Td) are by 10° C., without being limitative thereto. If there is need for fine control, the range may be by 1° C. or 2° C., for example.

This heater rank can be set in every printing head, in nozzles of every predetermined number (including one), or in every set of nozzles configured to eject the same type of ink. In the case of setting the heater rank in every group of plural nozzles, or in the case of setting the common heater rank to plural heaters, it is possible to set the lowest rank or the highest rank among the heaters as the heater rank for all of the heaters. In the case of the lowest rank, the applied energy is effectively held down to a low level. On the other hand, in the case of highest rank, a favorable ink ejection performance is ensured. Alternatively, it is also possible to set an intermediate rank between the lowest rank and the highest rank of the plural heaters as the heater rank for them all.

The "rank medium" heater, under the double-pulse-drive control, can keep the amount of ink ejection constant until the base temperature reaches approximately 40° C. The heater having the lowest heater rank (rank Min), or the heater which requires the shortest time period from application of the drive voltage to initiation of ink foaming, can be under the double-pulse-drive control until the base temperature reaches 50° C. The heater having the highest heater rank (rank Max), or the heater which requires the longest time period from application of the drive voltage to initiation of ink foaming, can be under the double-pulse-drive control until the base temperature reaches 30° C.

What the above experiment proved is that the temperature range within which the double-pulse-drive control is effective varies depending on the heater rank.

Figure 22:
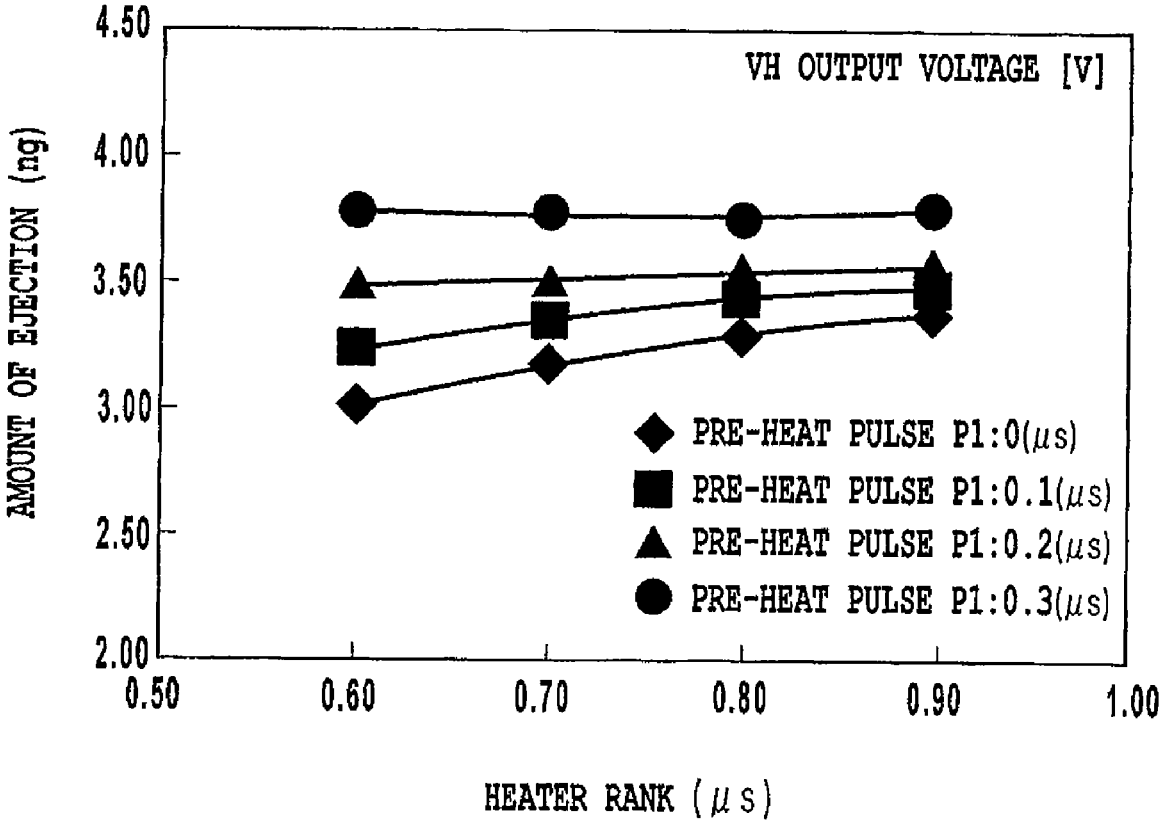
FIG. 22 is a graph for explaining relations between the base temperature and the amount of ink ejection in the embodiment of the present invention for different pre-pulse widths.

FIG. 22 is a graph showing a relation between the heater rank and the effect of the pre-heat pulse. The heater rank corresponds to the time that it takes for the application of the drive pulse to the heater to takes effect of foaming ink. A heater with the time equal to 0.60 μs ranks relatively low in the rank, while a heater with the time equal to 0.90 μs ranks relatively high. In this example, four types of printing heads in different heater ranks were subjected to the double-pulse-drive control, and the pre-heat-pulse width P1 (see FIG. 19) was changed for the heater of each printing heads to 0 μs, 0.1 μs, 0.2 μs, and 0.3 μs. The result here demonstrated that the change in the amount of ink ejection is larger in the case of a heater in a lower heater rank than in the case of a heater in a higher rank. This is attributed to the following reason. The heater which ranks lower in the heater rank brings a larger heat quantity per unit time, or a larger heat flux, to be transmitted to the ink. The lower-ranking heater transmits a relatively larger quantity of heat to the ink even with the same pre-heat pulse being applied to. Accordingly, the portion of the high temperature layer of the ink that contributes to ink foaming can be made thicker.

A relatively low drive voltage is preferable for the heater under the double-pulse-drive control. As shown in FIG. 22, in the case of the heater that ranks higher in the heater rank, or the heater with the smaller heat flux, a change in the pre-eat pulse causes a smaller variation in the amount of ink ejection. This makes a delicate control of the amount of ink ejection possible. For this reason, the double-pulse-drive control with a low drive voltage that causes a small heat flux is favorable. That is, under the double-pulse-drive control, the main-heat-pulse width P3 (see FIG. 19) is maintained at a fixed width even if the base temperature is changed. The main-heat-pulse width P3 may be varied depending on the heater rank.

Now, an analysis of the drive voltage after switching to the single-pulse-drive control is given below.

Figure 23:
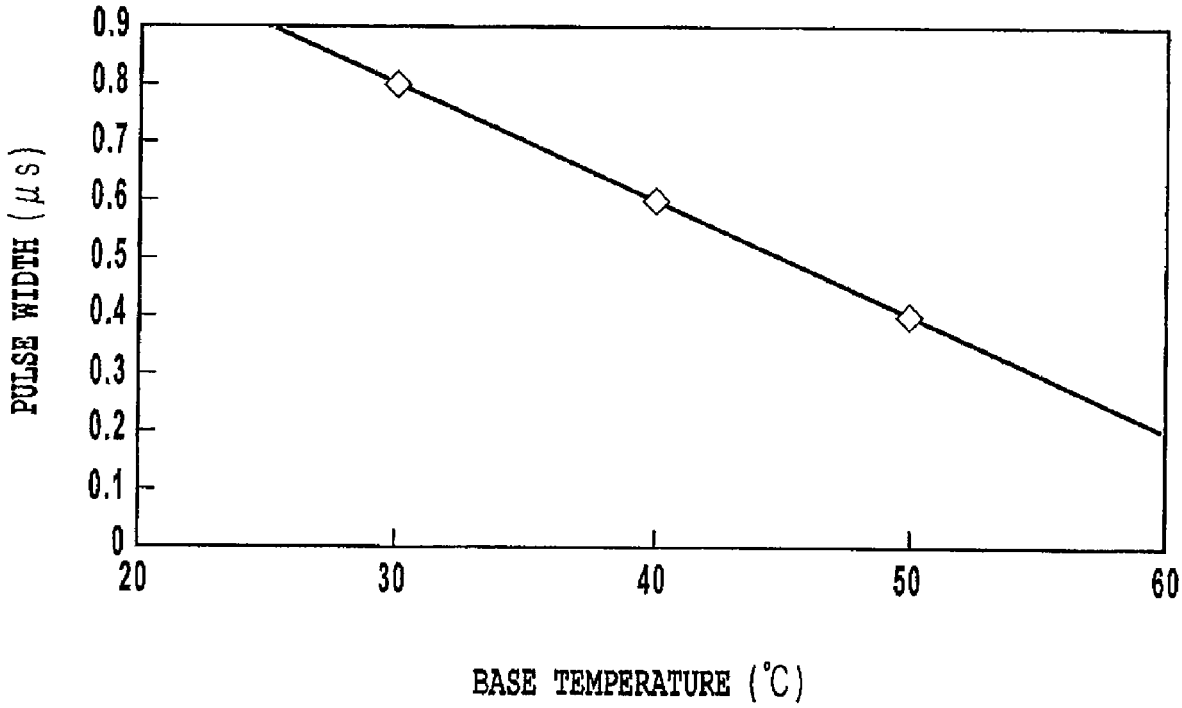
FIG. 23 is a graph showing relation between the base temperature and the pulse width in the embodiment of the present invention.

First, the relation between the temperature (the base temperature) of the printing head and the pulse width are assumed as follows. On condition that the amount of ink ejection reaches a certain target amount by applying single pulses with the widths of 0.80 μs, 0.60 μs, and 0.40 μs to the head with temperatures of 30° C., 40° C., and 50° C., respectively, the relation between the head temperature and the pulse width is described as shown in FIG. 23, and the following relational expression holds true:

$$\text{Pulse width}=(-0.02)\times(\text{head temperature})+(1.4)$$

The pulse width corresponding to the head temperature can be determined by use of this relational expression.

In performing the single-pulse-drive control by determining the pulse width in accordance with the above-described method, the drive voltage is set so as to make the energy applied to the heater constant. In this way, it is possible to keep the amount of ink ejection constant both in the double-pulse-drive control range with a constant drive voltage and in the single-pulse-drive control range with the drive voltage being modulated.

In the case of a heater in a heater rank configured not to foam the ink until a drive pulse with a larger width than the determined pulse width is applied, such a heater is caused to foam the ink with the determined pulse width by raising the drive voltage to increase the heat flux. On the other hand, in the case of a heater in a heater rank configured to foam the ink when a drive pulse also with a smaller width than the determined pulse width is applied, the heat flux is decreased by reducing the drive voltage. By setting the drive voltage as described above, it is possible to keep the amount of ink ejection constant at any head temperature irrespective of the heater rank. Setting the drive voltage can be done for every plurality of heaters or for every printing head, for example.

Figure 24:
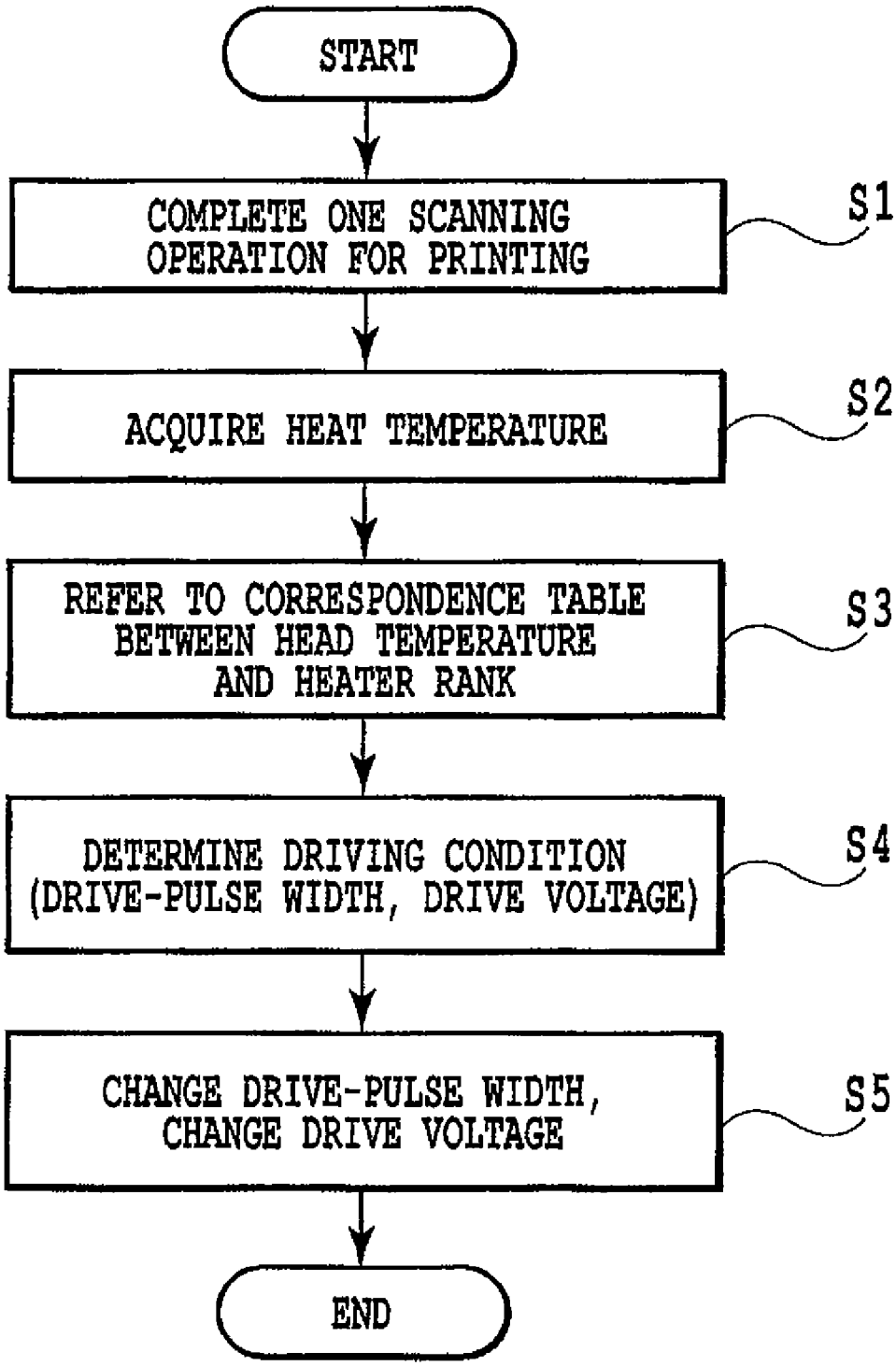
FIG. 24 is a flowchart for explaining a process for setting the driving condition of heater in the embodiment of the present invention.

FIG. 24 is a flow chart for explaining a series of processes concerning the drive pulse as described above.

First, the temperature of the printing head (the base temperature) is acquired by a temperature sensor such as a diode sensor every time a scanning for printing is completed (Steps S1 and S2). Then, with reference to the correspondence table between the head temperature and the heater rank as shown in FIG. 20 (Step S3), the driving condition of the heater corresponding to the heater rank and to the head temperature is determined. In other word, the pulse width of the drive pulse and the drive voltage are determined (Step S4). Thereafter, the driving condition of the heater is modified in response to the pulse width and the drive voltage thus determined (Step S5). The drive voltage can be changed on the basis of the control signal C by use of the circuit configuration as previously described in FIG. 12 or FIG. 14.

As described above, in this embodiment, the temperature of the printing head in printing operation is detected. On the basis of the detected temperature of the printing head combined with its heater rank, the optimum drive voltage and the optimum pulse width are selected. A drive control of the heater based on the drive voltage and the pulse width thus selected makes the amount of ink ejection stable.

SECOND EXAMPLE OF DRIVE CONTROL OF HEATER

In the first example, the single-pulse-drive control is performed on the basis of the drive voltage and the pulse width corresponding to the temperature range.

However, if the amount of ink ejection can be controlled by changing the only drive voltage, the single-pulse-drive control may be performed by changing the drive voltage depending on the temperature ranges while the pulse width P3 is kept constant. In the second example, the drive voltage is changed wile the pulse width is kept constant. For example, the drive voltage VH corresponding to the temperature range Ta is 20.5 volts, the drive voltage VH corresponding to the temperature range Tb is 20.6 volts, and the drive voltage VH corresponding to the temperature range Tc is 20.7 volts. In the ranges from Ta to Td, a value of the pulse width P3 is 0.77 μs (a value of the pulse width P1 is 0 μs).

THIRD EXAMPLE OF DRIVE CONTROL OF HEATER

A relation ship between the drive voltage and pulse width in each of the temperature ranges may be different from the first and second examples described above. A drive control may be done in which, for example, in the temperature ranges Ta and Tb, each of the drive voltage are equal and each of the pulse width are different. Specifically, a value of the pulse width P3 corresponding to the temperature range Ta is set to 0.78 μs (a value of the pulse width P1 is 0 μs), and a value of the pulse width P3 corresponding to the temperature range Tb is set to 0.76 μs (a value of the pulse width P1 is 0 μs). That is, the drive control is effected using one parameter with respect to the drive voltage in the temperature range of 20° C. (including the temperature ranges Ta and Tb) and using one parameter with respect to the pulse width in the temperature range of 10° C. (temperature range Ta or Tb).

Alternately, the other drive control may be effected in which the temperature range Ta is divided into two ranges TaL and TaH. Divided range TaL is 5° C. at a low temperature side of the range Ta, and divided range TaH is 5° C. at a high temperature side of the range Ta. In the temperature ranges TaL and TaH, the drive voltages are equal to each other and the pulse widths P3 are different from other.

FOURTH EXAMPLE OF DRIVE CONTROL OF HEATER

In the above-described example, the drive table shown in FIG. 20 takes the heater rank as a parameter in addition to the temperature of the printing head. However, when the fluctuation in the resistance value of the heater is ignorable, the drive table for a single rank will suffice. In this case, the voltage value and the pulse width are uniquely determined by the temperature of the printing head, and, on the basis of the voltage value and the pulse width, the printing head is subjected to the drive control.

Accordingly, when the fluctuation in the resistance value of the heater is ignorable, the process in Step S3 in FIG. 24 is referring to the table which takes the temperature of the printing head as the sole parameter. In Step S4, the pulse width and the drive voltage are determined based on the temperature of the printing head.

THIRD EXAMPLE OF HEAD-DRIVE-VOLTAGE-MODULATION CIRCUIT

Figure 25:
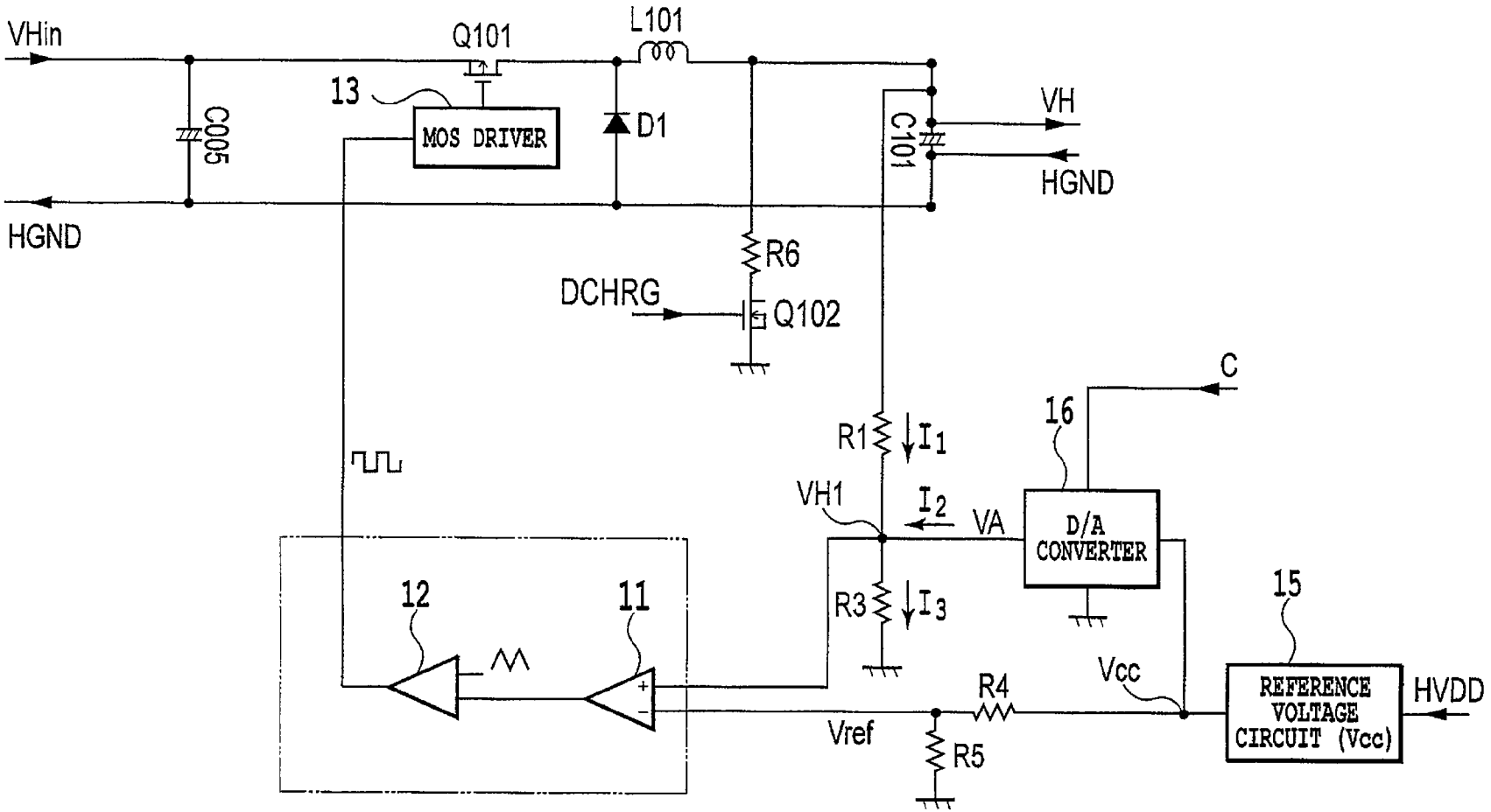
FIG. 25 is a circuit diagram for explaining another example of the DC/DC converter included in the head-drive-voltage-modulation circuit in FIG. 9.

FIG. 25 illustrates an aspect in which a discharge circuit is added to the above-described head-drive-voltage-modulation circuit shown in FIG. 14. This discharge circuit is configured to discharge electric charges accumulated in a capacitor C101, and includes a switching element Q102 and a resistor R6. Features of this circuit other than the discharge circuit are identical to the circuit shown in FIG. 14. Accordingly, the discharged circuit will be described in the following and explanations of other constituents of the circuit will be omitted herein.

In the discharge circuit, the switching element Q102 is turned on by a DCHRG signal received from the ASIC provided on the main substrate after receiving the voltage setting signal C from the controller, and an electric current is supplied from the capacitor C101 for a certain period of time through the resistor R6. With this process, the voltage of the capacitor C101, i.e. the output voltage VH is reduced.

In this example, electric energy to be applied to the capacitor C101 in response to the voltage setting signal C received from the ASIC provided on the main substrate is greater than the electric energy to be discharged by the discharge circuit. Therefore, up and down control of the output voltage VH is performed by the sure discharge operation of the discharge circuit at timing set by the voltage setting signal C. In this way, the level of the output voltage VH is adjusted with the feedback control by the head drive voltage modulation circuit combined with the discharging process.

Here, in the case where the voltage value of VH is reduced from VHa to VHb while a capacitance value of an output capacitor of a DC/DC converter is equal to C101 and the resistance is equal to R6, the period of time during which the switching element Q102 is on, "ton," for short, is expressed by the following formula.

$$\text{ton} = -R6 \times C101 \times \ln\frac{VHb}{VHa} \qquad \text{(Formula 8)}$$

In addition to the method described above, the level of the output voltage VH may be adjusted by a method in which operating the discharge circuit at timing set by the voltage setting signal C only when the output voltage VH is to be reduced.

OTHER EXAMPLES OF DRIVE CONTROL OF HEATER

The values of the drive voltage and pulse width are not limited to those described in the first to fourth examples. Furthermore, the first to fourth examples may be combined with each other. There may be a case where it is possible to employ a configuration to modulate the drive voltage in a wide range. In addition, there may be a case where it is possible to keep the amount of ink ejection constant in a broad temperature range even by use of a modulation range of the drive voltage. In such cases, controlling the amount of ink ejection can be done by the single-pulse-drive control alone, i.e. by use of only the single pulse not accompanied with the pre-heat pulse. When the amount of ink ejection is controlled by the single-pulse-drive control alone, speeding up of the printing operation and stabilizing the amount of ink ejection are both achieved simultaneously, as mentioned previously.

Moreover, in the above-described examples, the temperature of the printing head is detected for every scanning operation of the printing head, and, on the basis of the detected temperature, the driving condition is modified. Nevertheless, controlling the amount of ink ejection with more precision is made possible by detecting the temperature of the printing head for every ejection of ink from the printing head and modifying the driving condition accordingly. Alternatively, detection of the temperature of the printing head may be done on completion of every n times (n=2, 3, or 4) of the scanning operation for printing and the driving condition is modified accordingly. What is necessary for such a control to be carried out is a temperature sensor which is capable of accurately detecting the temperature of the printing head in printing operation and which is immune to such adverse effects as noises. Also necessary is a DC/DC converter capable of transforming the drive voltage in the microsecond order.

Other Embodiments

According to the present invention, it is possible to eject small ink droplets by raising the voltage of the drive pulse with the pulse width being reduced. In contrast, it is possible to eject large ink droplets by reducing the voltage of the drive pulse with the pulse width being increased.

In addition, the amount of ink ejection may fluctuate as the ejection ports of the printing heads are made unequal in area thereof (the area of the opening of the nozzle) during the manufacturing process. In this case, the present invention can also correct the amount of ejection appropriately.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-262370, filed Sep. 9, 2005, which is hereby incorporated by reference herein in its entirety.

What is claimed is:

1. An ink jet printing apparatus configured to print an image by using a printing head capable of ejecting ink by utilizing thermal energy generated upon application of a drive pulse to an electrothermal converter, the printing being performed by applying the ink ejected from the printing head onto a printing medium, the ink jet printing apparatus comprising:

an acquiring unit that acquires information on a temperature of the printing head; and a drive controlling unit that controls at least one of a voltage and pulse width of the drive pulse on the basis of the information, wherein the drive controlling unit executes, when the temperature of the printing head is lower than or equal to a predetermined temperature, first control in which the pulse width of the drive pulse is controlled on the basis of the information and the voltage of the drive pulse is kept constant, and wherein the drive controlling unit executes, when the temperature of the printing head is higher than the predetermined temperature, second control in which the voltage and pulse width of the drive pulse are controlled on the basis of the information.

2. The ink jet printing apparatus according to claim 1, wherein the voltage of the drive pulse in the second control is higher than that in the first control.

3. The ink jet printing apparatus according to claim 1, wherein the first control is double-pulse-drive control using a pre-heat pulse and a main heat pulse as the drive pulse, and wherein the second control is single-pulse-drive control using a single pulse as the drive pulse.

4. The ink jet printing apparatus according to claim 1, wherein in the second control, the pulse width of the drive pulse is controlled in accordance with the voltage of the drive pulse so as to keep an amount of the ink ejected from the printing head constant irrespective of the temperature of the printing head.

5. The ink jet printing apparatus according to claim 1, wherein in the second control, the voltage of the drive pulse is increased and the pulse width of the drive pulse is decreased as the temperature of the printing head becomes higher.

6. An ink jet printing method for printing an image by using a printing head capable of ejecting ink by utilizing thermal energy generated upon application of a drive pulse to an electrothermal converter, the printing being performed by applying the ink ejected from the printing head onto a printing medium, the ink jet printing method comprising the steps of:

acquiring information on a temperature of the printing head; and controlling at least one of a voltage and a pulse width of the drive pulse on the basis of the information, wherein the controlling step executes, when the temperature of the printing head is lower than or equal to a predetermined temperature, first control in which the pulse width of the drive pulse is controlled on the basis of the information and the voltage of the drive pulse is kept constant, and wherein the controlling step executes, when the temperature of the printing head is higher than the predetermined temperature, second control in which the voltage and pulse width of the drive pulse are controlled on the basis of the information.

* * * * *